US008444912B2

(12) United States Patent
Ohki

(10) Patent No.: US 8,444,912 B2
(45) Date of Patent: May 21, 2013

(54) HEAT TREATMENT FURNACE

(75) Inventor: Chikara Ohki, Kuwana (JP)

(73) Assignee: NTN Corporation, Osaka (JP)

( * ) Notice: Subject to any disclaimer, the term of this patent is extended or adjusted under 35 U.S.C. 154(b) by 0 days.

(21) Appl. No.: 12/675,958

(22) PCT Filed: Jun. 19, 2008

(86) PCT No.: PCT/JP2008/061230

§ 371 (c)(1),
(2), (4) Date: Mar. 1, 2010

(87) PCT Pub. No.: WO2009/028254

PCT Pub. Date: Mar. 5, 2009

(65) Prior Publication Data

US 2010/0213648 A1 Aug. 26, 2010

(30) Foreign Application Priority Data

Aug. 31, 2007 (JP) ..... 2007-226291

(51) Int. Cl.
*C23C 8/32* (2006.01)

(52) U.S. Cl.
USPC ..... 266/252; 73/863.11; 73/863.85; 266/249

(58) Field of Classification Search
USPC ..... 266/252, 249; 73/863.11, 863.85
See application file for complete search history.

(56) References Cited

U.S. PATENT DOCUMENTS

| | | | | |
|---|---|---|---|---|
| 2,648,976 | A * | 8/1953 | Bur | 73/23.31 |
| 3,964,872 | A * | 6/1976 | Karinkanta | 73/864.82 |
| 4,166,610 | A * | 9/1979 | Yamazaki et al. | 266/89 |
| 5,344,122 | A * | 9/1994 | Vuillermoz et al. | 266/79 |
| 5,578,147 | A * | 11/1996 | Nayar et al. | 148/508 |
| 5,759,482 | A * | 6/1998 | Gregory et al. | 266/79 |
| 7,276,204 | B2 * | 10/2007 | Ebihara et al. | 266/250 |
| 7,374,940 | B2 * | 5/2008 | Feugier | 436/34 |

FOREIGN PATENT DOCUMENTS

| | | | |
|---|---|---|---|
| JP | 8-013125 | | 1/1996 |
| JP | 08-013125 | * | 1/1996 |
| JP | 2003-302171 | | 10/2003 |
| JP | 2003-313637 | | 11/2003 |
| JP | 2007-154293 | | 6/2007 |

OTHER PUBLICATIONS

Yoshiki Tsunekawa et al., "Void Formation and Nitrogen Diffusion on Gas Carbonitriding," Heat Treatment, vol. 25, No. 5, 1985, pp. 242-247 with Partial English Translation.

* cited by examiner

*Primary Examiner* — Roy King
*Assistant Examiner* — Michael Aboagye
(74) *Attorney, Agent, or Firm* — McDermott Will & Emery LLP

(57) ABSTRACT

A heat treatment furnace that allows the atmosphere in the heat treatment furnace to be controlled with favorable accuracy includes a second heating zone identified as a reaction chamber, having a floor belt to hold a workpiece, and an atmosphere collect pipe having an opening in the second heating zone to collect an atmosphere in the second heating zone through the opening. The atmosphere collect pipe is installed to allow the distance between the opening and the floor belt to be modified.

5 Claims, 15 Drawing Sheets

HEAT TREATMENT FURNACE

RELATED APPLICATIONS

This application is the U.S. National Phase under 35 U.S.C. §371 of International Application No. PCT/JP2008/061230, filed on Jun. 19, 2008, which in turn claims the benefit of Japanese Application No. 2007-226291, filed on Aug. 31, 2007, the disclosures of which Applications are incorporated by reference herein.

TECHNICAL FIELD

The present invention relates to heat treatment furnaces, more particularly, a heat treatment furnace for heat-treating a workpiece formed of steel.

BACKGROUND ART

Generally in heat treatment of heating a workpiece formed of steel in a controlled atmosphere, the atmosphere in the heat treatment furnace is collected and analyzed while atmosphere gas is introduced therein to control the atmosphere in the heat treatment furnace by adjusting the flow rate of atmosphere gas introduced into the heat treatment furnace (the supplied amount per unit time) based on the analyzed result. Accordingly, surface modification, suppression of surface degradation due to oxidation, or the like is achieved.

For example, in a gas carbonitriding process applied to a workpiece formed of steel, the atmosphere in a heat treatment furnace is controlled by introducing R gas and ammonia ($NH_3$) gas into the heat treatment furnace at a constant flow rate, and controlling the carbon potential ($C_P$) value in the heat treatment furnace based on the partial pressure of carbon dioxide ($CO_2$) in the heat treatment furnace. It is difficult to directly measure the amount of nitrogen permeating into the surface layer of the workpiece during the carbonitriding process. In most cases, the amount of nitrogen permeating into the surface layer of the workpiece is controlled by adjusting the flow rate of ammonia gas that can be directly measured during a carbonitriding process, subsequent to empirically determining the relationship between the flow rate of ammonia gas and the amount of nitrogen permeating into the surface layer of a workpiece from past records of actual production in association with each heat treatment furnace.

The flow rate of ammonia gas is determined empirically, taking into account the mass, configuration and the like of the workpiece, based on the past records of actual production with respect to each heat treatment furnace. In the case where a workpiece of an amount or configuration whose records of actual production are not available is to be subjected to a carbonitriding process, the optimum flow rate of ammonia gas in the relevant carbonitriding process must be determined by trial and error. It is therefore difficult to render the quality of the workpiece stable until the optimum ammonia gas flow rate is determined. Moreover, since the trial and error must be carried out at the production line, workpieces that do not meet the required quality will be produced, leading to the possibility of increasing the production cost.

There is proposed a method of controlling the amount of nitrogen permeating into the workpiece by adjusting the undecomposed ammonia concentration (the concentration of residual ammonia gas) that is the concentration of gaseous ammonia remaining in the heat treatment furnace (for example, Yoshiki Tsunekawa et al. "Void Formation and Nitrogen Diffusion on Gas Carbonitriding" Heat Treatment, 1985, Vol. 25, No. 5, pp. 242-247 (Non-Patent Document 1) and Japanese Patent Laying-Open No. 8-013125 (Patent Document 1)), instead of controlling the flow rate of ammonia gas that varies depending upon the configuration of the heat treatment furnace, as well as upon the amount and configuration of each workpiece. Specifically, the undecomposed ammonia concentration that can be measured during a carbonitriding process is identified, and the flow rate of ammonia gas is adjusted based on the relationship between the undecomposed ammonia concentration and the amount of nitrogen permeating into the workpiece, which can be determined irrespective of the configuration of the heat treatment furnace and/or the amount and configuration of the workpiece. It is therefore possible to control the amount of nitrogen permeating into the workpiece without having to determine the optimum ammonia gas flow rate by trial and error. Therefore, the quality of the workpiece can be stabilized.

In addition, there is proposed a carbonitriding method allowing the permeating rate of nitrogen into a workpiece to be adjusted by employing, as a parameter, the $\gamma$ value that is the carbon activity divided by the volume fraction of undecomposed ammonia (for example, refer to Japanese Patent Laying-Open No. 2007-154293 (Patent Document 2)). Accordingly, the quality of the workpiece can be further stabilized, and an efficient carbonitriding process can be implemented.

Non-Patent Document 1: Yoshiki Tsunekawa et al. "Void Formation and Nitrogen Diffusion on Gas Carbonitriding" Heat Treatment, 1985, Vol. 25, No. 5, pp. 242-247.

Patent Document 1: Japanese Patent Laying-Open No. 8-013125

Patent Document 2: Japanese Patent Laying-Open No. 2007-154293

DISCLOSURE OF THE INVENTION

Problems to be Solved by the Invention

However, there is a case where the concentration of nitrogen in a workpiece cannot be controlled sufficiently even when the carbonitriding method disclosed in the aforementioned documents is employed. Specifically, there is a case where the amount of nitrogen permeating into the workpiece is lower than the expected amount such that the desired distribution of nitrogen concentration cannot be obtained even when the carbonitriding method disclosed in the aforementioned documents is carried out. It is considered that this may be due to the fact that the atmosphere in the heat treatment furnace is not necessarily controlled at an accuracy of sufficient level in a conventional heat treatment furnace.

An object of the present invention is to provide a heat treatment furnace that allows the atmosphere in the heat treatment furnace to be controlled with favorable accuracy.

Means for Solving the Problems

A heat treatment furnace of the present invention is directed to carrying out heat treatment on steel. The heat treatment furnace includes a reaction chamber having a holder to hold a workpiece, and an atmosphere collect member having an opening in the reaction chamber to collect an atmosphere in the reaction chamber through the opening. The atmosphere collect member is arranged to allow the distance between the opening and holder to be modified.

Generally in the heat treatment of heating a workpiece under controlled atmosphere, atmosphere gas is introduced into a heat treatment furnace that is heated to a predetermined temperature, and a workpiece is loaded into the heat treatment furnace upon confirming that the atmosphere in the heat treatment furnace attains a steady state. On the assumption that the atmosphere within the heat treatment furnace is uniform when the atmosphere therein attains a steady state, the atmosphere in the heat treatment furnace is analyzed and the atmosphere controlled based on the analyzed result. As a result of detailed study, the inventor found that the atmosphere in the heat treatment furnace does not necessarily attain an equilibrium situation even when the atmosphere in the heat treatment furnace attains a steady state, and the atmosphere in the heat treatment furnace may not be uniform. In the case where heat treatment is carried out with the atmosphere in the heat treatment furnace not uniform, it is desirable to collect the atmosphere of a region having components identical to that of the atmosphere in contact with the workpiece, i.e. the atmosphere in proximity to the workpiece, to analyze the composition of the relevant atmosphere, and then adjust the atmosphere in the heat treatment furnace based on the analyzed result. Namely, by installing an atmosphere collect member such that an opening to collect the atmosphere is located in proximity to the workpiece in a heat treatment furnace, the atmosphere in the heat treatment furnace can be controlled with favorable accuracy.

However, workpieces of various configuration and mass are heat-treated in a heat treatment furnace. If the approach of simply installing an atmosphere collect member such that the aforementioned opening is located in proximity to a holder holding a workpiece is employed in the heat treatment furnace, there is a possibility of interference between the workpiece and the atmosphere collect member in the event of the configuration and/or mass of the workpiece being changed.

In this context, the heat treatment furnace of the present invention has the atmosphere collect member installed such that the distance between the opening and the holder can be changed. Therefore, even in the case where the configuration and/or mass of the workpiece is changed, the distance between the opening and holder can be modified accordingly to allow collecting the atmosphere in the proximity of the workpiece. Upon analyzing the composition of the atmosphere obtained from the proximity of the workpiece, the atmosphere in the heat treatment furnace can be adjusted based on the analyzed result. According to the present invention, there can be provided a heat treatment furnace allowing the atmosphere in the heat treatment furnace to be controlled with favorable accuracy.

Preferably, the heat treatment furnace further includes a seal member surrounding the outer circumferential face of the atmosphere collect member, and an outward wall portion surrounding the outer circumferential face of the seal member, and connected to an outer wall of the reaction chamber. The atmosphere collect member is installed in a manner relatively movable with respect to the outward wall portion.

According to the configuration set forth above, the distance between the opening and holder can be modified by moving the atmosphere collect member with respect to the outward wall portion while suppressing leakage of the atmosphere from the heat treatment furnace by establishing a seal between the atmosphere collect member and the outward wall portion.

In the heat treatment furnace, the atmosphere collect member preferably includes a cylindrical portion having a tubular configuration. The seal member is disposed to surround the outer circumferential face of the cylindrical portion. The atmosphere collect member is installed in a manner relatively movable with respect to the outward wall portion in the axial direction of the cylindrical portion.

According to the configuration set forth above, the atmosphere collect member can move with respect to the outward wall portion while being sealed by the seal member at the cylindrical portion. As a result, the distance between the opening and holder can be modified smoothly. Although the cross sectional shape of the cylindrical portion, perpendicular to the axial direction of the cylindrical portion, may be polygonal, a circular cross section is advantageous in that the distance between the opening and holder can be modified more smoothly.

A plurality of seal members may be arranged, located separately, in the movable direction of the atmosphere collect member with respect to the outward wall portion. Accordingly, a seal can be established stably between the atmosphere collect member and outward wall portion during the movement of the atmosphere collect member with respect to the outward wall portion.

Preferably, the heat treatment furnace further includes a cooling portion to cool the seal member. In the heat treatment of steel, the steel is heated to a high temperature, for example 700° C. or above, so that the atmosphere in the heat treatment furnace is also at a high temperature. Therefore, there may be the case where the seal member is heated to a high temperature. In this case, the seal member may be degraded or damaged by the heat, leading to the possibility of insufficient sealing between the atmosphere collect member and outward wall portion. The provision of a cooling portion to cool the seal member allows the temperature increase of the seal member to be suppressed to prevent degradation and/or damage of the seal member.

In the heat treatment furnace, the heat treatment may be a carbonitriding process. In this case, the heat treatment furnace can further include an atmosphere analyzer connected to the atmosphere collect member to calculate the volume fraction of undecomposed ammonia in the atmosphere collected by the atmosphere collect member, and an atmosphere controller connected to the atmosphere analyzer to control the atmosphere in the reaction chamber based on the calculated volume fraction of undecomposed ammonia.

Generally in a carbonitriding process, the workpiece formed of steel is heated to a predetermined temperature in a heat treatment furnace into which gas such as R gas, enriched gas, ammonia gas, and the like is introduced. The $C_P$ value, the volume fraction of undecomposed ammonia, and the like in the heat treatment furnace are measured, and the amount of gas introduced into the heat treatment furnace is adjusted based on the measured values. At an elapse of sufficient time following introduction of the aforementioned gas into the heat treatment furnace, and after the atmosphere in the heat treatment furnace attains a steady state, the workpiece is loaded into the heat treatment furnace. On the assumption that the atmosphere in the heat treatment furnace is uniform, the $C_P$ value, the volume fraction of undecomposed ammonia, and the like are measured, and the atmosphere in the heat treatment furnace is controlled based on the measurements. However, there may be a problem that the concentration of nitrogen in the workpiece is not sufficiently controlled even in the case where the workpiece is loaded into the heat treatment furnace after the atmosphere in the heat treatment furnace attains a steady state.

The inventor studied in detail the uniformity of the volume fraction of undecomposed ammonia in the heat treatment furnace, and identified the following issues in association with the cause of the aforementioned problem.

The ammonia introduced into the heat treatment furnace is decomposed into nitrogen and hydrogen. The nitrogen permeates into the workpiece. The volume fraction of undecomposed ammonia in the heat treatment furnace is approximately 2000 ppm, for example, even under a steady state after gas such as R gas, enriched gas and ammonia gas are introduced into the heat treatment furnace. The equilibrium value of the volume fraction of undecomposed ammonia in the vicinity of 850° C. that is the temperature where a carbonitriding process is generally carried out is approximately 100 ppm. Upon studying the distribution of the undecomposed ammonia volume fraction in the heat treatment furnace, the volume fraction of undecomposed ammonia was not uniform even when the atmosphere in the heat treatment furnace attains a steady state. It was appreciated that this is the cause of the problem set forth above.

The decomposition reaction of ammonia introduced into the heat treatment furnace takes a non-equilibrium situation even when the atmosphere in the heat treatment furnace attains a steady state. Although the volume fraction of undecomposed ammonia at the same point of site in the heat treatment furnace is substantially constant, the undecomposed ammonia volume fraction differs between two points of site where the time of arrival of the introduced ammonia differs. Therefore, in order to adjust the atmosphere based on the volume fraction of undecomposed ammonia in the heat treatment furnace to control the nitrogen concentration in the workpiece with favorable accuracy, the atmosphere must be adjusted based on the volume fraction of undecomposed ammonia at a region where the undecomposed ammonia volume fraction is equal to the undecomposed ammonia volume fraction of the atmosphere in contact with the workpiece.

Since the distance between the opening of the atmosphere collect member and the holder holding the workpiece can be modified according to the configuration set forth above, the atmosphere in proximity to the region occupied by the workpiece in the heat treatment furnace is collected by the atmosphere collect member, and the volume fraction of undecomposed ammonia in the atmosphere is calculated at the atmosphere analyzer to allow the atmosphere in the reaction chamber of the heat treatment furnace to be controlled based on the volume fraction. Thus, by controlling the atmosphere in the heat treatment furnace with favorable accuracy according to the configuration set forth above, there can be provided a heat treatment furnace that allows the nitrogen concentration in the workpiece to be controlled with favorable accuracy.

As used herein, the region occupied by a workpiece in the heat treatment furnace refers to the region where the workpiece is arranged, particularly, the surface of the region, when heat treatment is performed without the position of the workpiece in the heat treatment furnace not changing such as in a batch type heat treatment furnace, and refers to the region corresponding to the traveling trajectory of the workpiece when heat treatment is performed while the position of the workpiece changes in the heat treatment furnace such as a continuous-furnace type heat treatment furnace. The volume fraction of undecomposed ammonia to be calculated is a numeric value having a one-to-one correspondence with the volume fraction of undecomposed ammonia in the atmosphere. Further, the volume fraction of undecomposed ammonia refers to the volume fraction of ammonia in the atmosphere inside the heat treatment furnace, remaining as gaseous ammonia without being decomposed.

Effects of the Invention

As can clearly be understood from the description above, according to the present invention, there can be provided a heat treatment furnace that allows the atmosphere in the heat treatment furnace to be controlled with favorable accuracy.

DESCRIPTION OF THE REFERENCE CHARACTERS

Figure 1:
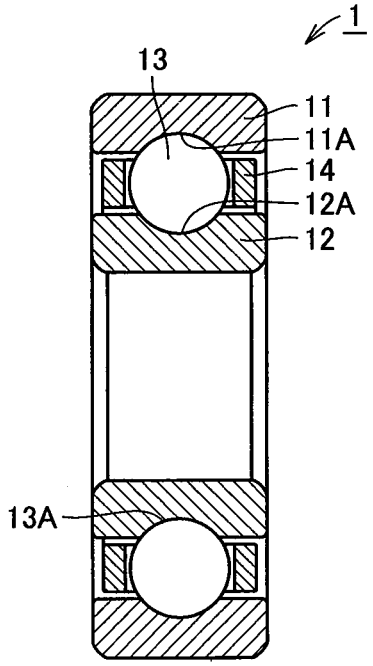
FIG. 1 is a schematic sectional view of a configuration of a deep groove ball bearing including a machinery component subjected to a carbonitriding process in a heat treatment furnace of the first embodiment.

1 deep groove ball bearing, 2 thrust needle roller bearing, 3 constant velocity joint, 5 heat treatment furnace, 11 outer ring, 11A outer ring raceway, 12 inner ring, 12A inner ring raceway, 13 ball, 13A ball rolling contact surface, 14, 24 cage, 21 bearing ring, 21A bearing ring raceway, 23 needle roller, 23A roller rolling contact surface, 31 inner race, 31A inner race ball groove, 32 outer race, 32A outer race ball groove, 33 ball, 34 cage, 35, 36 shaft, 51 main unit, 51A preheating zone, 51B first heating zone, 51C second heating zone, 51C1 top wall, 51C2 bottom wall, 51D third heating zone, 52 partition, 53 floor belt, 54 slot, 55 outlet, 56 atmosphere collect pipe, 56A opening, 57 atmosphere analyzer, 58 atmosphere controller, 59 fan, 61 atmosphere gas supplier, 91 workpiece, 92 workpiece passage region, 93 workpiece proximity region, 511 protection tube, 511A inner wall, 511B outer wall, 511C flow inlet, 511D outlet, 511E cooling medium flow channel, 511F inner diameter enlarged portion, 519 seal hold member, 561 pipe portion, 561A large diameter portion, 562 cylindrical member, 563 ring member, 563A groove, 621 cylindrical seal, 622 disk seal, 623 U-packing, 623A support ring, 623C groove, 624 annular seal, 631 support member, 632 nut.

BEST MODES FOR CARRYING OUT THE INVENTION

Embodiments of the present invention will be described hereinafter based on the drawings. In the drawings, the same or corresponding elements have the same reference characters allotted, and the description thereof will not be repeated.

[First Embodiment]

First, a deep groove ball bearing as a roller bearing according to a first embodiment of the present invention will be described hereinafter with reference to FIG. 1.

Referring to FIG. 1, a deep groove ball bearing 1 includes an annular outer ring 11, an annular inner ring 12 arranged at the inner side of outer ring 11, and a plurality of balls 13 serving as rolling elements arranged between outer and inner rings 11 and 12, held in a cage 14 of a circular ring configuration. An outer ring raceway 11A is formed at the inner circumferential face of outer ring 11. An inner ring raceway 12A is formed at the outer circumferential face of inner ring 12. Outer ring 11 and inner ring 12 are disposed such that inner ring raceway 12A and outer ring raceway 11A face each other. The plurality of balls 13 are held in a rollable manner on the circular raceway, in contact with the inner ring raceway 12A and outer ring raceway 11A, disposed at a predetermined pitch in the circumferential direction by means of cage 14. By such a configuration, outer ring 11 and inner ring 12 of deep groove ball bearing 1 can be rotated relative to each other.

Among outer ring 11, inner ring 12, ball 13 and cage 14 that are machinery components, particularly outer ring 11, inner ring 12 and ball 13 require rolling fatigue strength and wear resistance. By employing at least one thereof as a machinery component subjected to a carbonitriding process in the heat treatment furnace of the present invention, the surface layer is strengthened by controlling the nitrogen concentration in the component with favorable accuracy to increase the lifetime of deep groove ball bearing 1.

A thrust needle roller bearing qualified as a rolling bearing according to a modification of the first embodiment will be described hereinafter with reference to FIG. 2.

Figure 2:
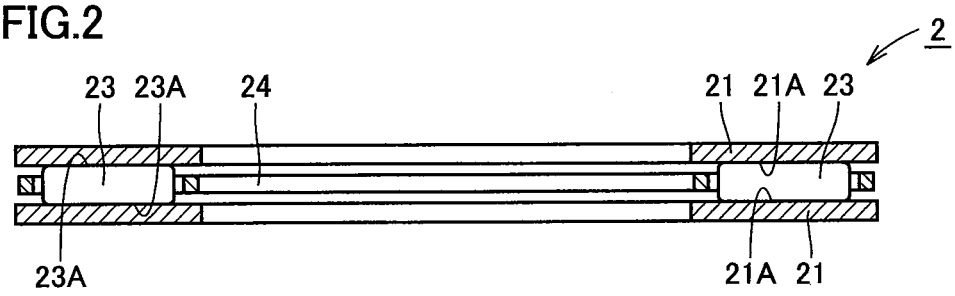
FIG. 2 is a schematic sectional view of a configuration of a thrust needle roller bearing including a machinery component subjected to a carbonitriding process in a heat treatment furnace of the first embodiment.

Referring to FIG. 2, a thrust needle roller bearing 2 includes a pair of bearing rings 21 taking a disk shape, serving as a rolling member arranged such that one main surface faces each other, a plurality of needle rollers 23 serving as a rolling member, and a cage 24 of a circular ring configuration. The plurality of needle rollers 23 are held, at roller raceway (outer circumferential face) 23, in a rollable manner on the circular raceway, in contact with bearing ring raceway 21A formed at the main surfaces of the pair of bearing rings 21 facing each other, disposed at a predetermined pitch in the circumferential direction by means of cage 24. By such a configuration, the pair of bearing rings 21 of thrust needle roller bearing 2 can be rotated relative to each other.

Among bearing ring 21, needle roller 23, and cage 24 that are machinery components, particularly bearing ring 21 and needle roller 23 require rolling fatigue strength and wear resistance. By employing at least one thereof as a machinery component subjected to a carbonitriding process in the heat treatment furnace of the present invention, the surface layer is strengthened by controlling the nitrogen concentration in the component with favorable accuracy to increase the lifetime of thrust needle roller bearing 2.

Figure 3:
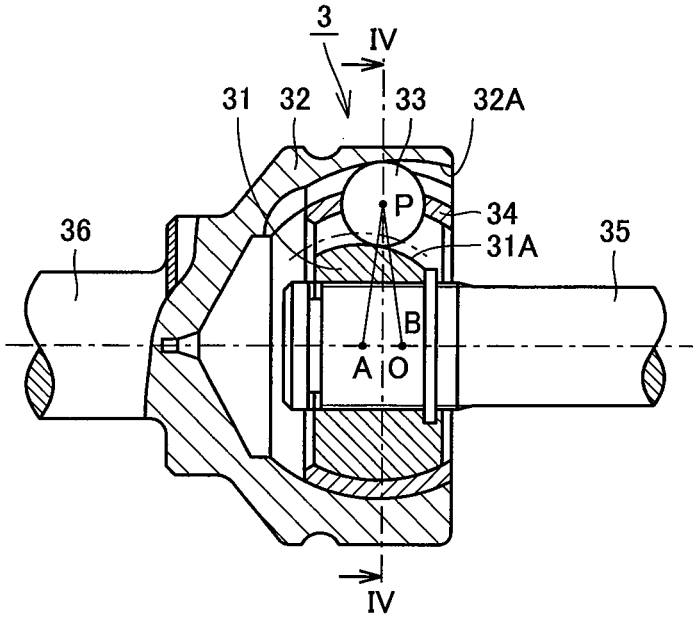
FIG. 3 is a schematic partial sectional view of a configuration of a constant velocity joint including a machinery component subjected to a carbonitriding process in a heat treatment furnace of the first embodiment.

A constant velocity joint according to another modification of the first embodiment will be described hereinafter with reference to FIGS. 3-5. FIG. 3 is a schematic sectional view taken along line III-III of FIG. 4.

Figure 4:
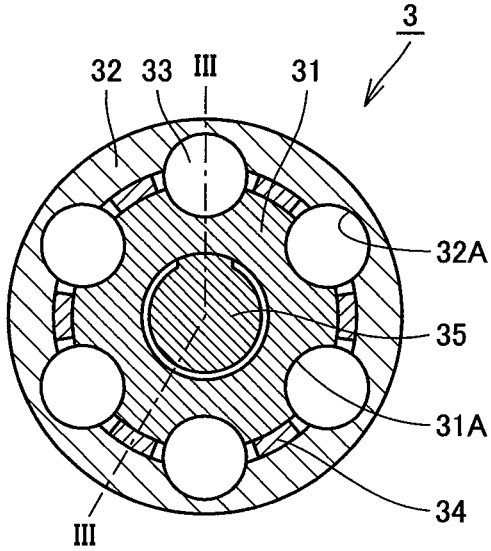
FIG. 4 is a schematic sectional view taken along line IV-IV of FIG. 3.
Figure 5:
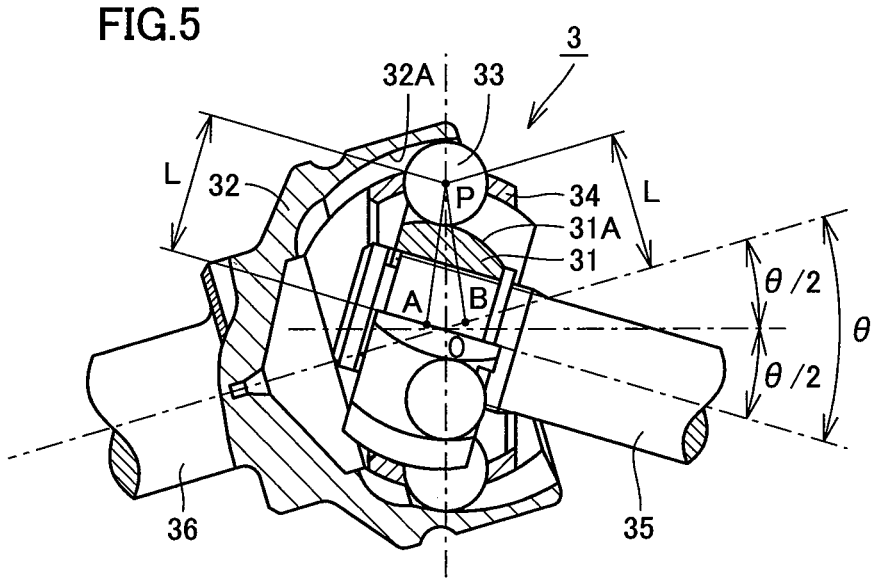
FIG. 5 is a schematic partial sectional view of the constant velocity joint of FIG. 3 in an angled posture.

Referring to FIGS. 3-5, a constant velocity joint 3 includes an inner race 31 coupled to a shaft 35, an outer race 32 arranged to surround the outer circumferential side of inner race 31 and coupled to shaft 36, a ball 33 for torque transmission, arranged between inner race 31 and outer race 32, and a cage 34 for holding ball 33. Ball 33 is arranged in contact with an inner race ball groove 31A formed at the outer circumferential face of inner race 31 and an outer race ball groove 32A formed at the inner circumferential face of outer race 32, and held by cage 34 to avoid falling off.

As shown in FIG. 3, inner race ball groove 31A and outer race ball groove 32A located at the outer circumferential face of inner race 31 and the inner circumferential face of outer race 32, respectively, are formed in a curve (arc) with points A and B equally spaced apart at the left and right on the axis passing through the center of shafts 35 and 36 in a straight line from the joint center O on the axis as the center of curvature. In other words, inner race ball groove 31A and outer race ball groove 32A are formed such that the trajectory of center P of ball 33 that rolls in contact with inner race ball groove 31A and outer race ball groove 32A corresponds to a curve (arc) with point A (inner race center A) and point B (outer race center B) as the center of curvature. Accordingly, ball 33 is constantly located on the bisector of an angle (∠AOB) with respect to the axis passing through the center of shafts 35 and 36 even when the constant velocity joint is operated at an angle (when the constant-velocity joint moves such that the axes passing through the center of shafts 35 and 36 cross).

The operation of constant velocity joint 3 will be described hereinafter. Referring to FIGS. 3 and 4, when the rotation about the axis is transmitted to one of shafts 35 and 36 at constant velocity joint 3, this rotation is transmitted to the other of shafts 35 and 36 via ball 33 placed in inner race ball groove 31A and outer race ball groove 32A. In the case where shafts 35 and 36 constitute an angle of θ as shown in FIG. 5, ball 33 is guided by inner race ball groove 31A and outer race ball groove 32A with inner race center A and outer race center B as the center of curvature to be held at a position where its center P is located on the bisector of ∠AOB. Since inner race ball groove 31A and outer race ball groove 32A are formed such that the distance from joint center O to inner race center A is equal to the distance from joint center O to outer race center B, the distance from center P of ball 33 to respective inner race center A and outer race center B is equal. Thus, triangle OAP is congruent to triangle OBP. As a result, the distance L from center P of ball 33 to shafts 35 and 36 are equal to each other. When one of shafts 35 and 36 rotates about the axis, the other also rotates at constant velocity. Thus, constant velocity joint 3 can ensure constant velocity even in the state where shafts 35 and 36 constitute an angle. Cage 34 serves, together with inner race ball groove 31A and outer race ball groove 32A, to prevent ball 33 from jumping out of inner race ball groove 31A and outer race ball groove 32A when shafts 35 and 36 rotate, and also to determine joint center O of constant velocity joint 3.

Among inner race 31, outer race 32, ball 33 and cage 34 that are machinery components, particularly inner race 31, outer race 32 and ball 33 require fatigue strength and wear resistance. By taking at least one thereof as the machinery component subjected to a carbonitriding process in the heat treatment furnace of the present invention, the surface layer is strengthened by controlling the nitrogen concentration in the component with favorable accuracy to increase the lifetime of constant velocity joint 3.

Figure 6:
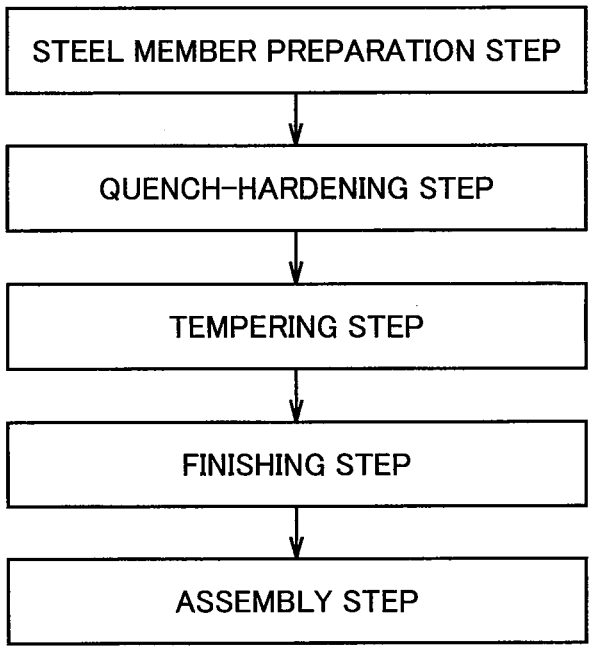
FIG. 6 schematically represents a fabrication method of a machinery component of the first embodiment and a mechanical element including such a machinery component.

The foregoing machinery component of the present embodiment, and a fabrication method of a machinery element such as a rolling bearing and constant velocity joint including such a machinery component will be described hereinafter. Referring to FIG. 6, first a steel member preparation step of preparing a steel member formed of steel, shaped roughly in a configuration of a machinery component, is carried out. Specifically, a steel bar, for example, is used as the basic material. This steel bar is subjected to processing such as cutting, forging, turning and the like to be prepared as a steel member shaped roughly into the configuration of a machinery component such as outer ring 11, bearing ring 21, inner race 31, or the like.

The steel member prepared at the steel member preparation step is subjected to a carbonitriding process, and then cooled down to a temperature equal to or less than $M_S$ point from the temperature of at least $A_1$ point. This corresponds to the quench-hardening step of quench-hardening the steel member. Details of the quench-hardening step will be described afterwards.

As used herein, $A_1$ point refers to the temperature point where the steel structure transforms from ferrite into austenite. $M_S$ point refers to the temperature point where martensite is initiated during cooling of the austenitized steel.

Then, the steel member subjected to the quench-hardening step is heated to a temperature of not more than $A_1$ point. This tempering step is carried out to improve the toughness and the like of the steel member that has been quench-hardened. Specifically, the quench-hardened steel member is heated to a temperature of at least 150° C. and not more than 350° C., for example 180° C., that is a temperature lower than $A_1$ point, and maintained for a period of time of at least 30 minutes and not more than 240 minutes, for example 120 minutes, followed by being cooled in the air of room temperature (air cooling).

Further, a finishing step such as machining is applied on the steel member subjected to the tempering step. Specifically, a grinding process is applied on inner ring raceway 12A, bearing ring raceway 21A, outer race ball groove 32A and the like identified as a steel member subjected to the tempering step. Thus, a machinery component according to the first embodiment is completed, and the fabrication method of a machinery component according to the first embodiment ends. In addition, an assembly step of fitting the completed machinery component to build a machinery element is implemented. Specifically, outer ring 11, inner ring 12, ball 13 and cage 14, for example, that are machinery fabricated by the steps set forth above are fitted together to build a deep groove ball bearing 1. Thus, a machinery element including a machinery component according to the first embodiment is fabricated.

The details of a quench-hardening step in the fabrication method of a machinery component carried out using the heat treatment furnace of the present embodiment will be described with reference to FIGS. 7-13. In FIG. 13, the horizontal direction corresponds to time with the elapse in the rightward direction, whereas the vertical direction corresponds to temperature, representing a higher temperature as a function of height.

Figure 7:
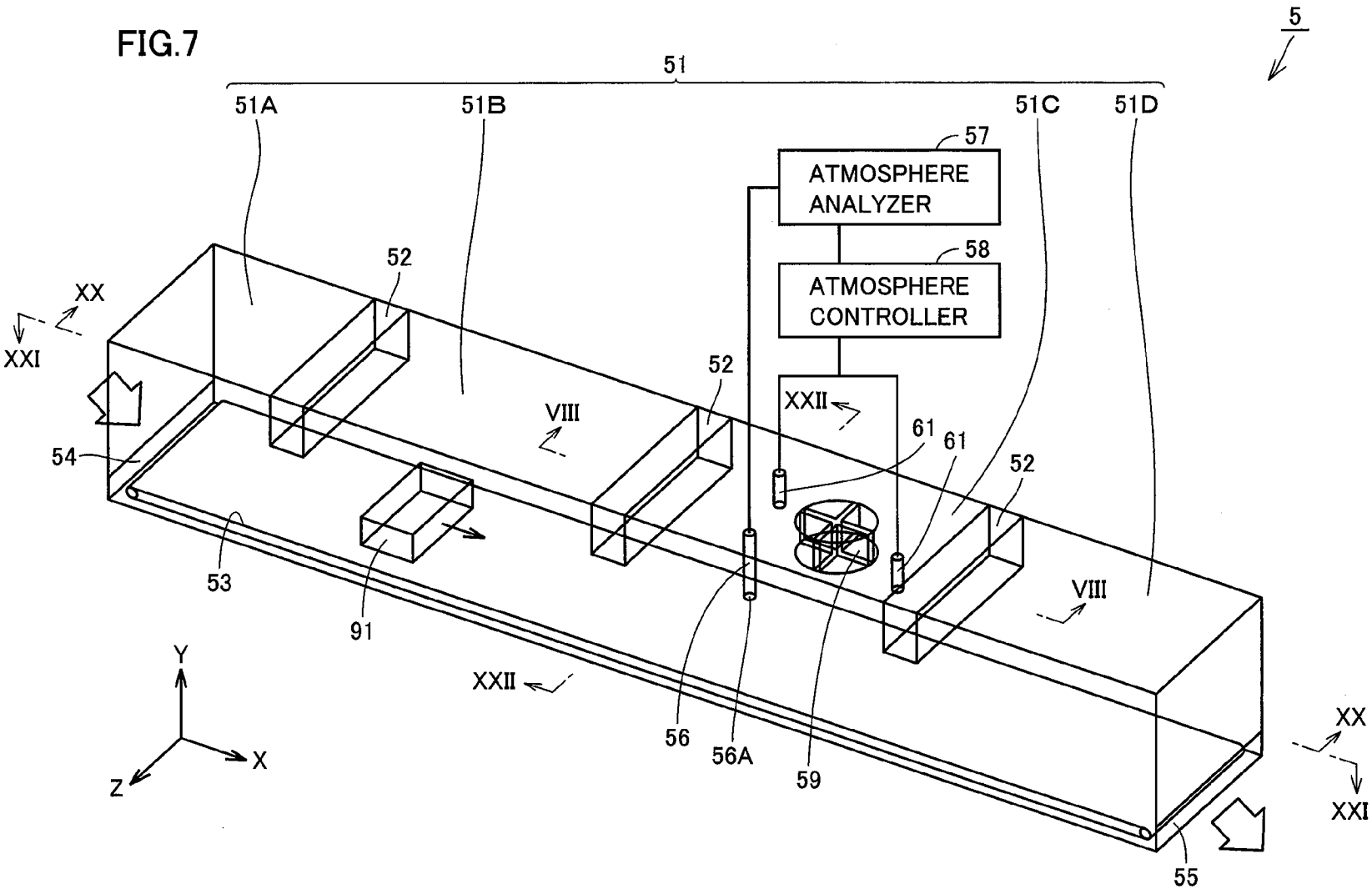
FIG. 7 is a schematic diagram of a configuration of a heat treatment furnace of the first embodiment.

First, a heat treatment furnace of the present embodiment will be described. Referring to FIG. 7, a heat treatment furnace 5 of the present embodiment is of the continuous furnace type to carry out a carbonitriding process on steel. Heat treatment furnace 5 includes a main unit 51 surrounded by walls, an atmosphere collect pipe 56, an atmosphere analyzer 57, and an atmosphere controller 58.

At one end of main unit 51 in the longitudinal direction (X axis direction), a slot 54 that is an opening for loading a workpiece 91 is formed. At the other end of main unit 51 in the longitudinal direction, an outlet 55 that is an opening for unloading workpiece 91 is formed. Along the bottom wall of main unit 51, a floor belt 53 holding workpiece 91 input through slot 54, identified as a holder to convey workpiece from slot 54 to outlet 55, is arranged. Further, main unit 51 has three partitions 52, 52, 52 arranged, extending from one end to the other end of the main unit in the width direction (Z axis direction), protruding from the top wall of main unit 51 towards floor belt 53 with a distance from floor belt 53. The three partitions 52, 52, 52 are arranged aligning in the longitudinal direction of main unit 51. Accordingly, main unit 51 is divided into four zones along the longitudinal direction, i.e. a preheating zone 51A, a first heating zone 51B, a second heating zone 51C, and a third heating zone 51D, sequentially from the side of slot 54.

Figure 8:
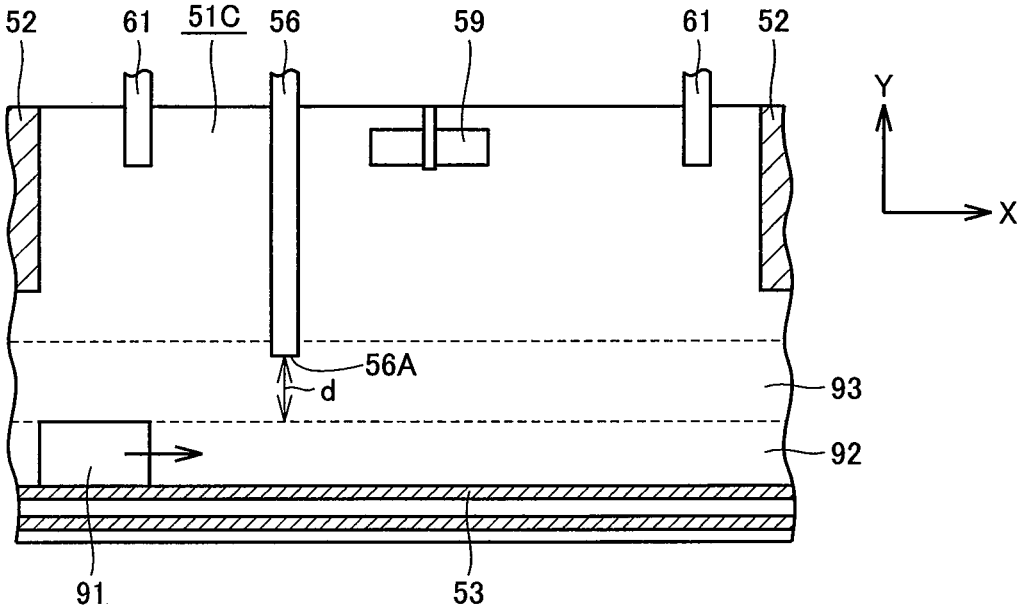
FIG. 8 is a schematic partial sectional view taken along line VIII-VIII of FIG. 7.

Referring to FIGS. 7 and 8, second heating zone 51C serving as a reaction chamber has installed thereat an atmosphere collect pipe 56 having an opening 56A in second heating zone 51C, identified as an atmosphere collect member collecting the atmosphere in second heating zone 51C, an atmosphere analyzer 57 connected to atmosphere collect pipe 56 to calculate the volume fraction of undecomposed ammonia in the atmosphere, and an atmosphere controller 58 connected to atmosphere analyzer 57 to control the atmosphere within second heating zone 51C based on the calculated volume fraction of undecomposed ammonia. At top wall 51C1 in second heating zone 51C are installed an atmosphere gas supplier 61 supplying atmosphere gas such as R gas, enriched gas, and ammonia gas into second heating zone 51C, and a fan 59 serving as a stirrer to stir the atmosphere gas in second heating zone 51C.

Referring to FIG. 8, the position of opening 56A of atmosphere collect pipe 56 is adjusted to be located at a workpiece proximity region 93 that is the region where the difference in the volume fraction of undecomposed ammonia from the region occupied by workpiece 91 held by floor belt 53, i.e. workpiece passage region 92 corresponding to the trajectory of workpiece 91 carried and moved by floor belt 53 (the entire region occupied by the travel of workpiece 91), is within 25%. When the carbon activity is, for example, 0.95, the volume fraction of undecomposed ammonia must be greater than or equal to 0.2% in order to maximize the permeating rate of nitrogen into the workpiece. At least 90% the maximum value can be ensured as the nitrogen permeating rate when the volume fraction is 0.15%. In other words, by adjusting the atmosphere based on the volume fraction of undecomposed ammonia at the region where the difference in the volume fraction of undecomposed ammonia is less than or equal to 25% from that in the region occupied by the workpiece in the heat treatment furnace, the nitrogen concentration in the workpiece can be controlled with high accuracy.

Figure 9:
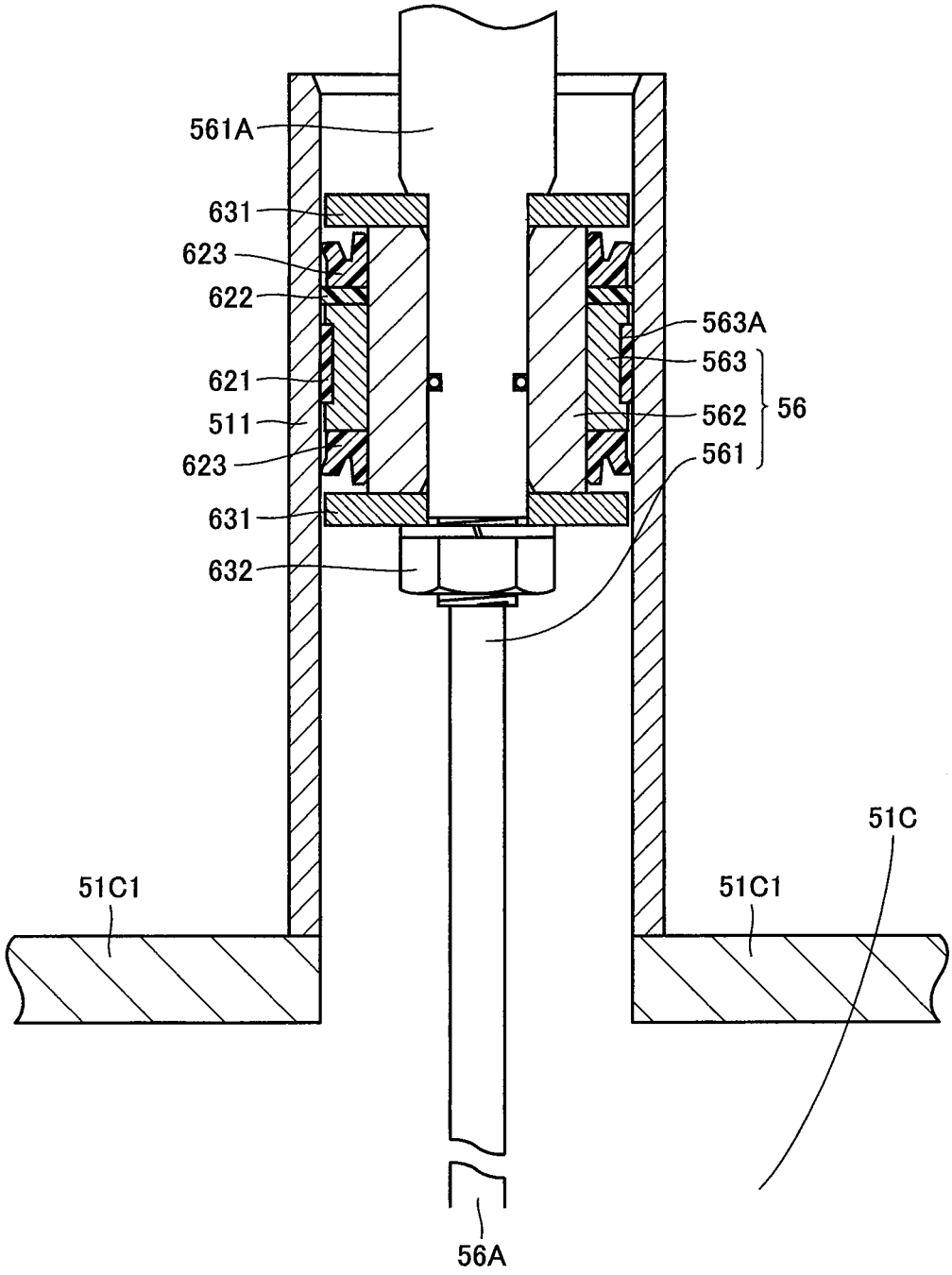
FIG. 9 is a schematic partial sectional view of the neighborhood of an atmosphere collect pipe of FIGS. 7 and 8 in an enlarged form.

An atmosphere collect pipe will be described hereinafter as the atmosphere collect member of the present embodiment. Referring to FIGS. 8 and 9, atmosphere collect pipe 56 is disposed to pierce top wall 51C1 at second heating zone 51C. This atmosphere collect pipe 56 includes a pipe portion 561 of a hollow cylindrical configuration, having an opening 56A in second heating zone 51C, and allowing passage of the atmosphere in second heating zone 51C therethrough, a cylindrical member 562 that is a tubular portion arranged to surround the outer circumferential face of pipe portion 561, and a ring member 563 that is a tubular portion arranged to surround the outer circumferential face of cylindrical member 562. A groove 563A is formed along the outer circumferential face of ring member 563 at the central region, having an outside diameter smaller than the end portion of the circumferential face.

A cylindrical seal 621 serving as a seal member having a cylindrical tubular configuration is fitted into groove 563A. Further, a disk seal 622 serving as a seal member having a circular shape is arranged to form contact with the end face of ring member 563 at the side opposite to the side where opening 56A is located with respect to ring member 563. Moreover, U-packings 623, 623 of an annular configuration with one end face bifurcated are arranged to form contact with an end face of ring member 563 opposite to the side where disk seal 622 is located, and with an end face of disk seal 622 at the side opposite to the side where ring member 563 is located, respectively. Each of U-packings 623, 623 is arranged such that the bifurcated side is located opposite to ring member 563.

In addition, disk-like support members 631, 631 are arranged to form contact with respective end faces at either side of cylindrical member 562. A large diameter portion 561A having a diameter larger than that of an adjacent region is formed at pipe portion 561. One support member 631 is sandwiched between large diameter portion 561A and cylindrical member 562. The other support member 631 is sandwiched between cylindrical member 562 and a nut 632 fitted onto pipe portion 561. By tightening nut 632, cylindrical member 562 is supported by support members 631, 631.

A cylindrical hollow protection tube 511 protruding outwards from top wall 51C1 at second heating zone 51C, identified as an outward wall portion, is formed to surround the outer circumferential faces of cylindrical seal 621, disk seal 622 and U-packings 623 that are seal members. At least a portion of each of cylindrical seal 621, disk seal 622, and U-packing 623 that are seal members is brought into close contact with protection tube 511. Each of cylindrical seal 621, disk seal 622 and U-packings 623 that are seal members is slidable with respect to protection tube 511 in the axial direction of pipe portion 561. As a result, atmosphere collect pipe 56 can move relative to protection tube 511 while establishing a seal between atmosphere collect pipe 56 and protection tube 511. The distance between opening 56A and floor belt 53 (refer to FIG. 8) can be modified. In other words, atmosphere collect pipe 56 can move relative to protection tube 511 together with cylindrical seal 621, disk seal 622 and U-packings 623 that are seal members. Further, the arrangement of cylindrical seal 621, disk seal 622, and U-packings 623 that are a plurality of seal members aligned in the axial direction of atmosphere collect pipe 56 allows a sufficient seal to be established between atmosphere collect pipe 56 and protection tube 511.

Protection tube 511 and pipe portion 561 must have high resistance to heat since they are exposed to a carbonitriding atmosphere of high temperature. Therefore, stainless steel, stainless alloy, inconel, carbon steel or the like may be employed as the material for protection pipe 511. For the material of pipe portion 561, stainless steel, stainless alloy, inconel, or the like may be cited. There is a possibility of cylindrical seal 621, disk seal 622 and U-packings 623 serving as seal members being heated to high temperature due to the contact with protection tube 511. These seal members must be slidable with respect to protection tube 511 while maintaining contact with atmosphere collect pipe 56 and protection tube 511. In this context, ethylene resin, phenol resin, or the like may be employed for the material of cylindrical seal 621. For the material of disk seal 622, ethylene resin, polyamide resin, or the like may be cited. For the material of U-packing 623, nitrile rubber, fluoro-rubber, or the like may be cited.

An example of specific procedures to adjust the position of opening 56A of atmosphere collect pipe 56 in second heating zone 51C will be described hereinafter.

Figure 10:
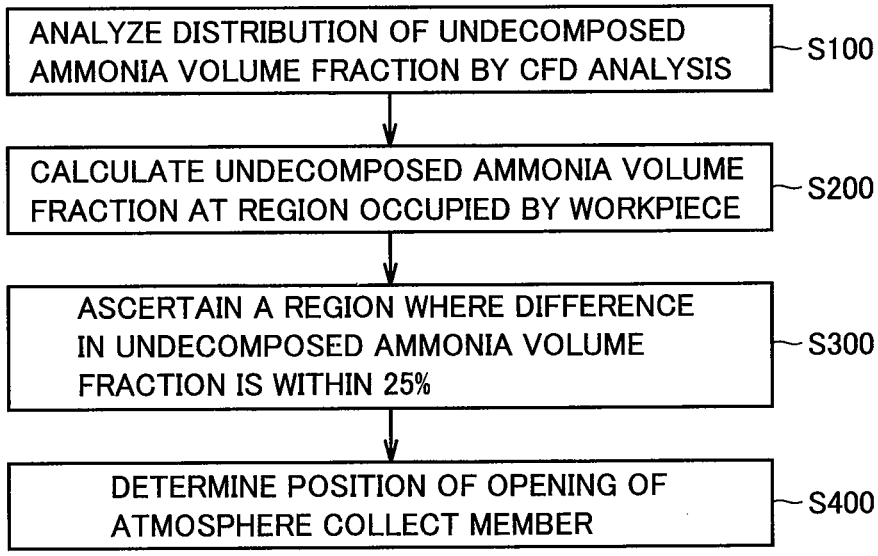
FIG. 10 is a flowchart to describe specific procedures in adjusting the position of the opening of the atmosphere collect pipe.

Reference is given to FIGS. 7, 8 and 10. At step S100, the volume fraction of undecomposed ammonia in main unit 51 of heat treatment furnace 5, particularly in second heating zone 51C, is analyzed based on CFD (Computational Fluid Dynamic) analysis. At step S200, the volume fraction of undecomposed ammonia at the region occupied by workpiece 91, for example workpiece passage region 92, is calculated based on the analyzed result of step S100. At step S300, a workpiece proximity region 93 where the difference in the volume fraction of undecomposed ammonia is within 25% from that calculated at step S200 is ascertained. At step S400, the position of opening 56A is determined so as to be located within workpiece proximity region 93 ascertained at step S300. Referring to FIG. 9, atmosphere collect pipe 56 is moved relative to protection tube 511 in the axial direction of pipe portion 561, whereby the position of opening 56A is adjusted to be located within workpiece proximity region 93.

The specific procedure of a quench-hardening process using heat treatment furnace 5 will be described hereinafter. At the quench-hardening step with reference to FIG. 7, a steel member identified as workpiece 91 is loaded from slot 54 to be mounted on floor belt 53. The loaded workpiece 91 is conveyed by floor belt 53 to be subjected to a carbonitriding process while sequentially passing through preheating zone 51A, first heating zone 51B, second heating zone 51C and third heating zone 51D. At preheating zone 51A, workpiece 91 is heated to be boosted in temperature. At first heating zone 51B, the temperature is rendered uniform such that workpiece 91 is further heated to have its temperature variation reduced. At second heating zone 51C, workpiece 91 is carbonitrided. At third heating zone 51D, workpiece 91 is subjected to temperature adjustment or the like, and then output through outlet 55 to be introduced into a coolant such as cooling oil to be cooled. Thus, quench-hardening is implemented.

Next, a quench-hardening step in the fabrication method of a machinery component according to the first embodiment using the above-described heat treatment furnace will be described. In the quench-hardening step with reference to FIG. 11, first a carbonitriding step is carried out such that the surface layer of a steel member that is a workpiece is carbonitrided. Then, at a cooling step, the steel member is cooled down to a temperature less than or equal to $M_S$ point from a temperature greater than or equal to $A_1$ point. Thus, quench-hardening is implemented. The carbonitriding step is implemented by a carbonitriding method of the first embodiment that is one of the embodiments in the present invention. Namely, the carbonitriding step includes an atmosphere control step of controlling the atmosphere in the heat treatment furnace, and a heating pattern control step of controlling the heating history applied to the steel member in the heat treatment furnace. The atmosphere control step and heating pattern control step can be carried out independently, and concurrently.

Figure 12:
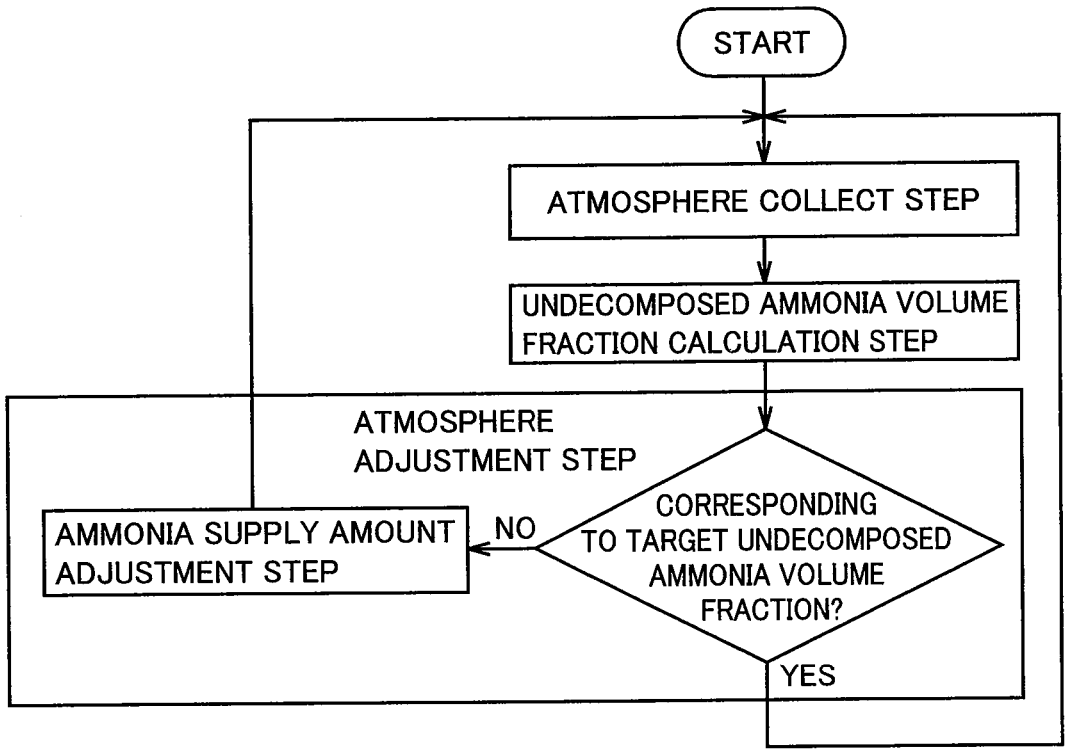
FIG. 12 is a diagram to describe the details of an atmosphere control step of FIG. 11.
Figure 13:
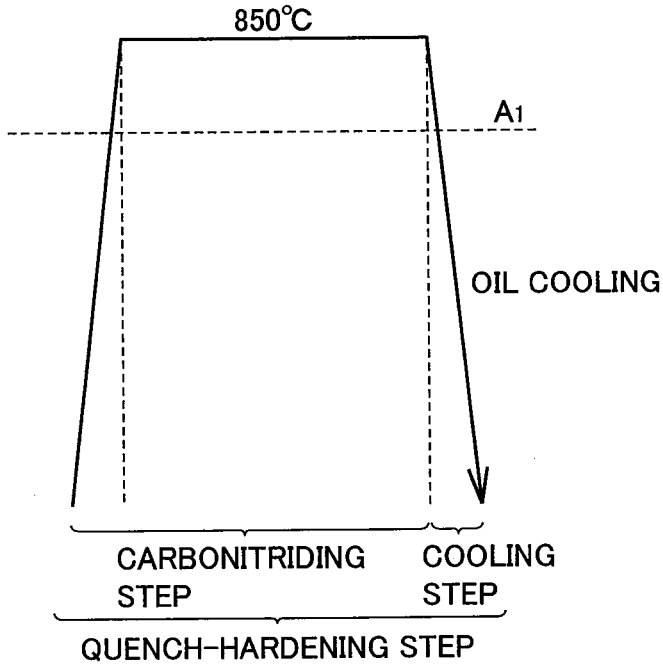
FIG. 13 represents an example of a heating pattern (temperature history applied to workpiece) in a heating pattern control step of FIG. 11.

In the atmosphere control step with reference to FIG. 12, an atmosphere collect step of collecting the atmosphere in second heating zone 51C of heat treatment furnace 5 is carried out. Specifically, referring to FIG. 8, the atmosphere in second heating zone 51C is collected through atmosphere collect pipe 56 having an opening 56A located in second heating zone 51C. Referring to FIG. 12, an undecomposed ammonia volume fraction calculation step of calculating the volume fraction of undecomposed ammonia in the collected atmosphere is carried out. Specifically, the collected atmosphere as shown in FIGS. 7 and 8 is analyzed by a gas chromatograph included in, for example, atmosphere analyzer 57, whereby the volume fraction of undecomposed ammonia in the atmosphere is calculated. Referring to FIGS. 7, 8 and 12, an atmosphere adjustment step of adjusting the atmosphere in second heating zone 51C by atmosphere controller 58 based on the calculated undecomposed ammonia volume fraction is carried out. Specifically, when the volume fraction of undecomposed ammonia in the atmosphere calculated at the undecomposed ammonia volume fraction calculation step is not equal to the target undecomposed ammonia volume fraction, an ammonia supply amount adjustment step to increase or decrease the volume fraction of undecomposed ammonia in second heating zone 51C is carried out, followed by an atmosphere collect step again.

The ammonia supply amount adjustment step can be carried out by adjusting the amount of ammonia flowing into second heating zone 51C per unit time (flow rate of ammonia gas) via atmosphere gas supplier 61 from an ammonia gas cylinder coupled to heat treatment furnace 5 via a pipe using a flow rate control device including a mass flow controller attached to the pipe. Specifically, when the measured undecomposed ammonia volume fraction is higher than the target undecomposed ammonia volume fraction, the aforementioned flow rate is decreased. When the measured undecomposed ammonia volume fraction is lower than the target undecomposed ammonia volume fraction, the flow rate is increased. Thus, an ammonia supply amount adjustment step is carried out. In this ammonia supply amount adjustment step, when there is a predetermined difference between the measured undecomposed ammonia volume fraction and the target undecomposed ammonia volume fraction, how much the flow rate is to be increased/decreased can be determined based on the relationship between the increase/decrease of the flow rate of ammonia gas and the increase/decrease of undecomposed ammonia volume fraction, determined empirically in advance.

Referring to FIG. 12, when the undecomposed ammonia volume fraction corresponds to the target undecomposed ammonia volume fraction, the atmosphere collect step is carried out again without execution of the ammonia supply amount adjustment step.

In the atmosphere collect step with reference to FIGS. 8 and 12, the atmosphere of workpiece proximity region 93 that is a region where the difference in the undecomposed ammonia volume fraction from workpiece passage region 92 is within 25% when a CFD analysis of the atmosphere in second heating zone 51C is implemented based on an analysis condition including the ammonia decomposition reaction rate, is collected through atmosphere collect pipe 56 having an opening 56A.

Figure 11:
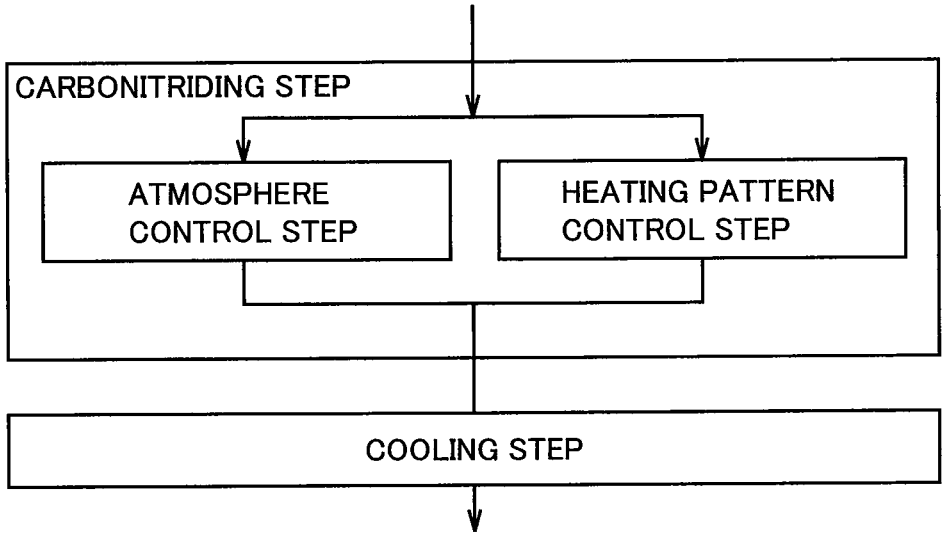
FIG. 11 is a diagram to describe a quench-hardening step in the fabrication method of a machinery component of the first embodiment.

In a heating pattern control step with reference to FIG. 11, the heating history applied to the steel member identified as workpiece 91 is controlled. Specifically, as shown in FIG. 13, in an atmosphere where the steel member is controlled by the atmosphere control step set forth above, the steel member is heated to a temperature of at least 800° C. and not more than 1000° C. that is a temperature greater than or equal to $A_1$ point, for example to 850° C., and maintained for a period of at least 60 minutes and not more than 300 minutes, for example for 150 minutes. At the elapse of the maintaining period, the heating pattern control step ends. The atmosphere control step also ends at the same time (carbonitriding step). This heating pattern control step is carried out by controlling the temperature of each of preheating zone 51A, first heating zone 51B, second heating zone 51C and third heating zone 51D shown in FIG. 7 such that the heating pattern of FIG. 13 is applied to workpiece 91 by the sequential passage of workpiece 91 through each of the aforementioned zones.

Then, referring to FIGS. 7, 11 and 13, the cooling step of cooling workpiece 91 down to a temperature less than or equal to $M_S$ point from the temperature greater than or equal to $A_1$ point is carried out by immersing workpiece 91 output through outlet 55 in oil stored in a quenching oil tank not shown (oil cooling). The steel member has its surface layer carbonitrided and quench-hardened by the process set forth above. Thus, the quench-hardening step of the present embodiment is completed.

In the carbonitriding method (carbonitriding step) of the present embodiment using heat treatment furnace 5, the atmosphere of workpiece proximity region 93 in second heating zone 51C of heat treatment furnace 5 is collected, from which the volume fraction of undecomposed ammonia in the atmosphere is calculated, and the atmosphere in second heating zone 51C is adjusted based on the calculated volume fraction. According to the carbonitriding method using the heat treatment furnace of the present embodiment set forth above, the nitrogen concentration in workpiece 91 can be readily controlled. Since the carbonitriding method set forth above using the heat treatment furnace of the present embodiment is employed in the carbonitriding step according to the machinery component fabrication method of the present embodiment, a machinery component having the internal nitrogen concentration controlled with favorable accuracy can be fabricated.

[Second Embodiment]

A second embodiment will be described hereinafter as one embodiment of the present invention. In the second embodiment, the heat treatment furnace, carbonitriding method, machinery component fabrication method, and machinery component have a configuration and provide advantages basically similar to those of the first embodiment described based on FIGS. 1-13. The heat treatment furnace of the second embodiment differs from the first embodiment in the configuration of protection tube 511.

Figure 14:
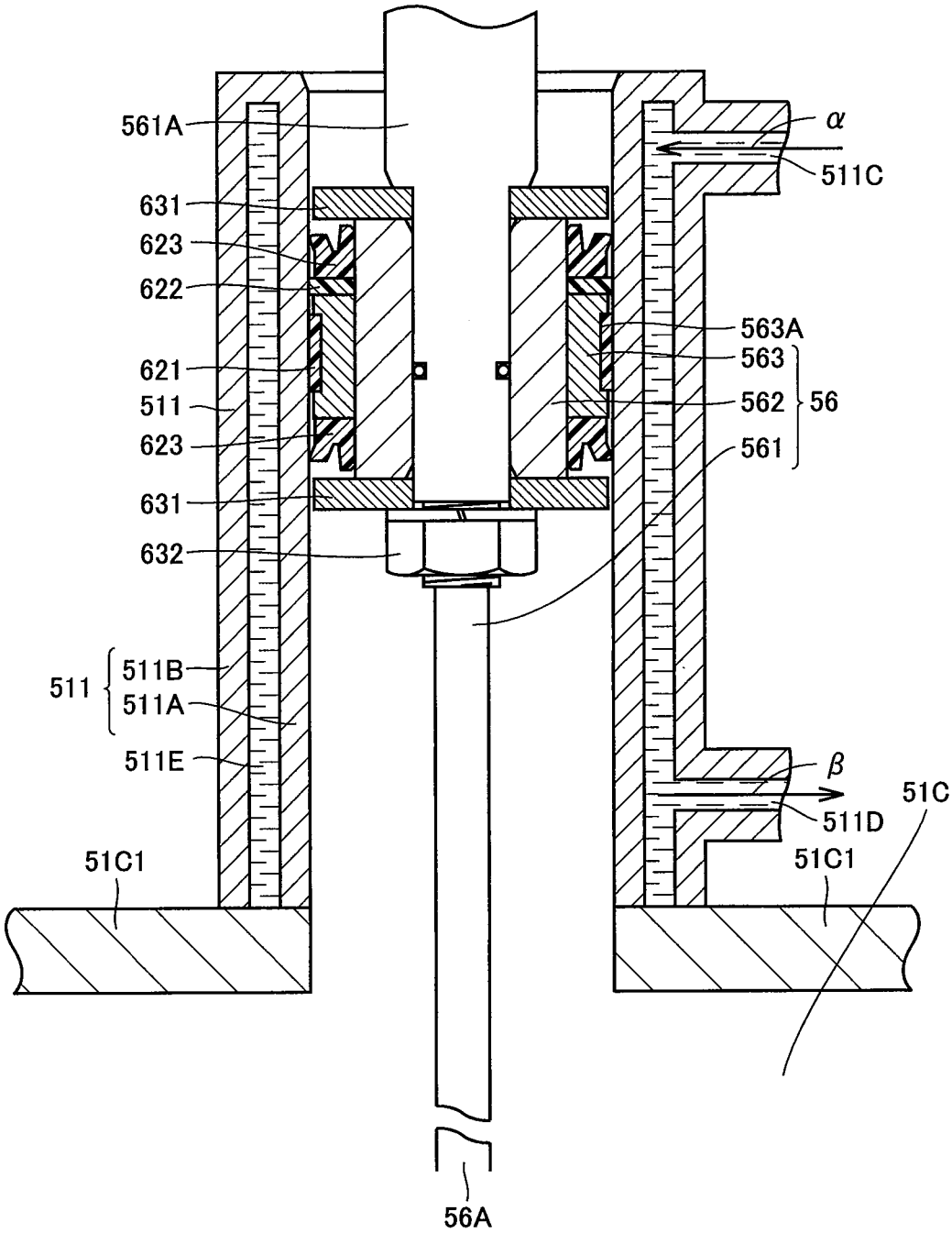
FIG. 14 is a schematic partial sectional view of the neighborhood of an atmosphere collect pipe of FIGS. 7 and 8 in an enlarged form.

Referring to FIG. 14, a protection tube 511 of the second embodiment includes a cylindrical inner wall 511A in contact with cylindrical seal 621, disk seal 622 and U-packings 623 identified as seal members, and a cylindrical outer wall 511B surrounding the outer circumferential face of inner wall 511A. There is a gap between inner wall 511A and outer wall 511B. This gap corresponds to a cooling medium flow channel 511E for the passage of cooling water that is a cooling medium. A flow inlet 511C that is an opening for introduction of cooling water, and an outlet 511D from which the cooling water is output are formed at outer wall 511B. Namely, inner wall 511A of protection tube 511 that is the outward wall portion of heat treatment furnace 5 in the second embodiment has a cooling medium flow channel 511E formed serving as a cooling medium flowing region as the cooling portion surrounding inner wall 511A.

During operation of heat treatment furnace 5, the cooling water supplied from a cooling water circulation device including a pump and the like not shown flows into cooling medium flow channel 511E in the direction of arrow α from flow inlet 511C and then output from outlet 511D in the direction of arrow β. Accordingly, protection tube 511 as well as cylindrical seal 621, disk seal 622 and U-packings 623 identified as seal members are cooled to suppress degradation or damage caused by the heat of the seal members. As a result, the seal between atmosphere collect pipe 56 and protection tube 511 can be further ensured.

Although an element through which a cooling medium such as cooling water flows may be employed for the cooling portion installed at inner wall 511A of protection tube 511 that is the outward wall portion, as set forth above, a mechanism of blowing on high pressure air may also be employed.

[Third Embodiment]

A third embodiment will be described hereinafter as an embodiment of the present invention. In the third embodiment, the heat treatment furnace, carbonitriding method, machinery component fabrication method, and machinery component have a configuration and provide advantages basically similar to those of the first embodiment described based on FIGS. 1-13. The heat treatment furnace of the third embodiment differs from the first embodiment in the configuration around the atmosphere collect pipe.

Figure 15:
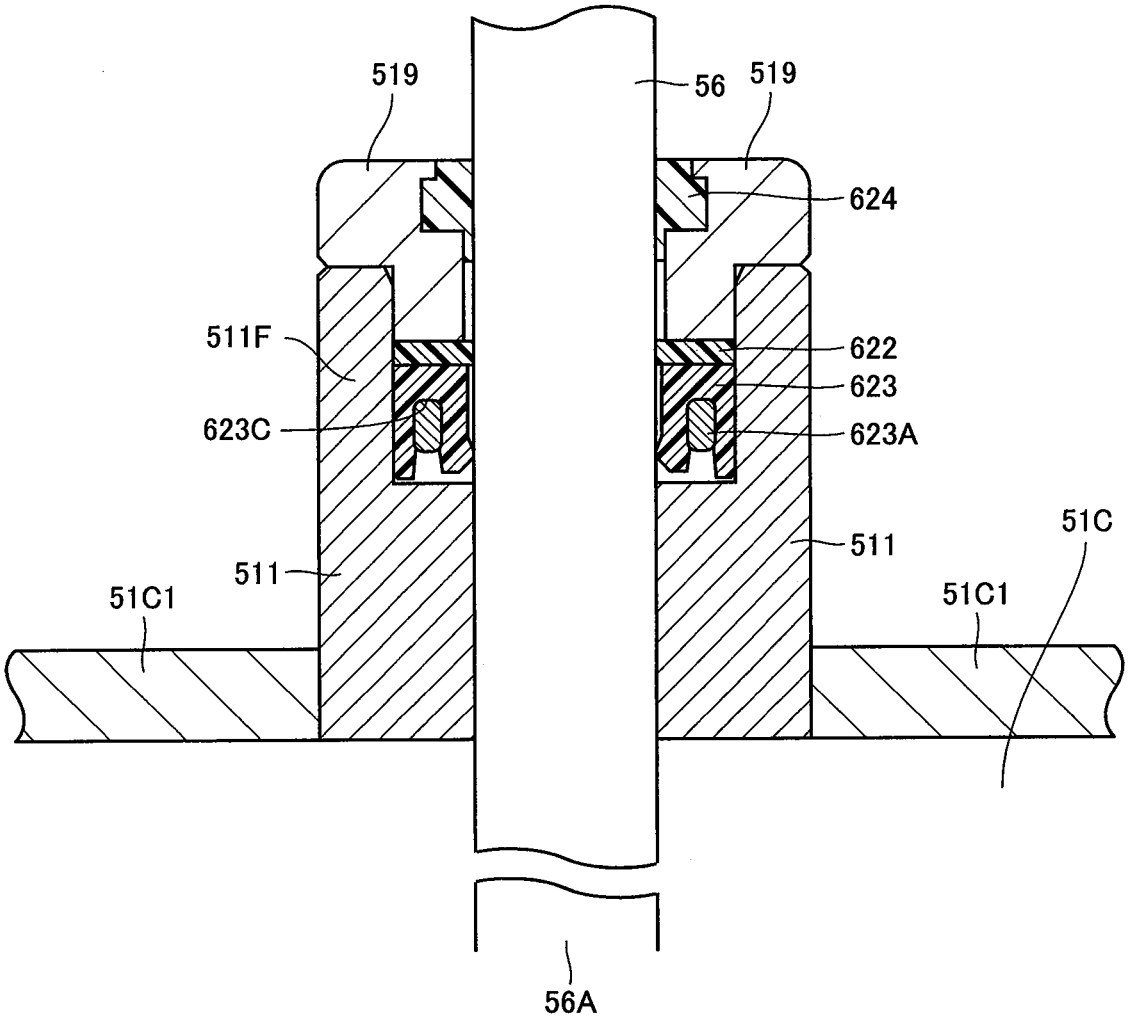
FIG. 15 is a schematic partial sectional view of the neighborhood of an atmosphere collect pipe of FIGS. 7 and 8 in an enlarged form.

Referring to FIG. 15, an atmosphere collect pipe 56 identified as an atmosphere collect member of the third embodiment passing through protection tube 511 to reach as far as the interior of second heating zone 51C has a hollow cylindrical configuration. Protection tube 511 includes an inner diameter enlarged portion 511F that is a region having an inner diameter larger than that of an adjacent region. A U-packing 623 is disposed between the inner circumferential face of inner diameter enlarged portion 511F of protection tube 511 and the outer circumferential face of atmosphere collect pipe 56. A support ring 623A supporting U-packing 623 is fitted in a groove 623C of U-packing 623 formed having one end bifurcated. Further, a disk seal 622 is disposed forming contact with an end face of U-packing 623 at the side opposite to groove 623C.

In addition, an annular seal hold member 519 identified as an outward wall portion is arranged in contact with an end face of protection tube 511 at the side opposite to second heating zone 51C, and with an end face of disk seal 622 at the side opposite to the U-packing 623 side, and so as to surround the outer circumferential face of atmosphere collect pipe 56. An annular seal 624 identified as a seal member having an annular shape is arranged between the inner circumferential face of seal hold member 519 and the outer circumferential face of atmosphere collect pipe 56.

Close contact is established between at least a portion of each of disk seal 622 and U-packing 623 serving as seal members and protection tube 511, and between at least a portion of annular seal 624 and seal hold member 519 identified as seal members. Atmosphere collect pipe 56 forms close contact and is slidable in the axial direction with respect to each of disk seal 622, U-packing 623, and annular seal 624 that are seal members. As a result, atmosphere collect pipe 56 is movable relative to protection tube 511 and seal hold member 519 while establishing a seal therebetween, allowing the distance between opening 56A and floor belt 53 (refer to FIG. 8) to be modified.

Namely, atmosphere collect pipe 56 is movable by sliding with respect to disk seal 622, U-packing 623, and annular seal 624 that are seal members, and protection tube 511 and seal hold member 519 that are outward wall portions.

There is a possibility of annular seal 624 identified as a seal member to be heated to high temperature due to the contact with atmosphere collect pipe 56 of high temperature. Atmosphere collect pipe 56 must be slidable with respect to annular seal 624 while forming contact. Therefore, as the material of annular seal 624, nitrile rubber, fluoro-rubber, or the like may be employed.

Although a component constituting a deep groove ball bearing, thrust needle roller bearing and constant velocity joint is described as an example of machinery components subjected to heat treatment (carbonitriding) in a heat treatment furnace of the present invention, the heat treatment furnace of the present invention is also suitable for heat treatment of other machinery components that require fatigue strength and abrasion wear at the surface layer such as a hub, gear, or shaft. Although the above embodiments have been described based on the case where a protection tube 511 protruding outwards from top wall 51C1 at second heating zone 51C is formed as the outward wall portion, the outward wall portion may correspond to, when top wall 51C1 is thick enough, a sidewall of a through hole formed at top wall 51C1.

EXAMPLE 1

Example 1 of the present invention will be described hereinafter. An experiment to study the relationship between the position of the opening of the atmosphere collect pipe in the heat treatment furnace and the control accuracy of the amount of nitrogen permeating into a workpiece was carried out. The procedure of the experiment is set forth below.

The experiment of Example 1 was carried out using the heat treatment furnace described in the first embodiment based on FIGS. 7 and 8. This heat treatment furnace is of the continuous furnace type having an entire length of 5000 mm. The workpiece (sample) was a JIS SUJ2 (1 mass % of carbon content) ring having an outer diameter of ϕ38 mm, an inner diameter of ϕ30 mm, and a width of 10 mm. Referring to FIGS. 7 and 8, workpiece 91 (sample) was loaded through slot 54 and conveyed by floor belt 53 in main unit 51 to be heat-treated. A heating pattern similar to that of FIG. 13 was employed, and the retention temperature was 850° C. Setting the target value of the carbon activity in second heating zone 51C at 0.95, and the target value of the γ value (the carbon activity divided by the undecomposed ammonia volume fraction) at 4.5, a carbonitriding process was applied to workpiece 91.

The heat treatment was carried out with the distance d between opening 56A of atmosphere collect pipe 56 and workpiece passage region 92 varied within a preferable range of 50 mm to 150 mm (Examples A-C) (the range where opening 56A is located in workpiece proximity region 93) and within the range of 200 mm-650 mm (Reference Examples A-E) that is outside the preferable range. The carbon activity and γ value at second heating zone 51C during the heat treatment were measured. The sample subjected to heat treatment was then cut at a cross section perpendicular to the surface, and the distribution of nitrogen concentration in the direction of depth from the surface was evaluated by EPMA (Electron Probe Micro Analysis). The main conditions in the heat treatment are shown in Table 1.

TABLE 1

| | |
|---|---|
| Heating temperature at second heating zone | 850° C. |
| Moving rate of workpiece | 40 mm/min |
| Flow rate of R gas into first heating zone | 10 $m^3$/h (volume flow-in) |
| Flow rate of R gas into second heating zone | 9 $m^3$/h (volume flow-in) |
| Fan revolution | 10 rpm |
| Flow out of atmosphere from slot | natural flow out |
| Flow out of atmosphere from outlet | 2 $m^3$/h (forced flow-out, volume flow-out) |
| Carbon activity at second heating zone (target value) | 0.95 |
| γ value at second heating zone (target value) | 4.5 |

Figure 16:
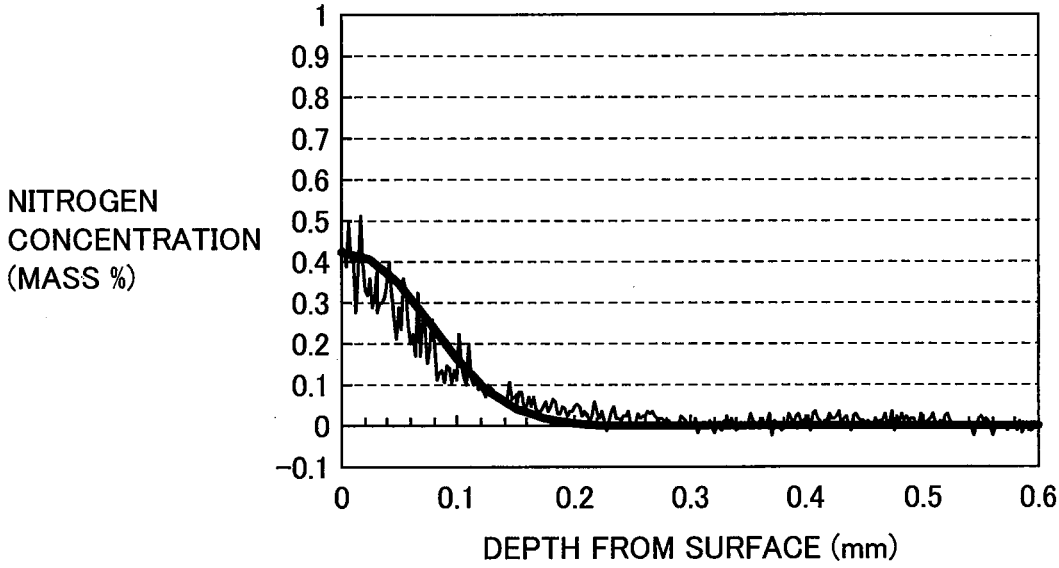
FIG. 16 represents a distribution of nitrogen concentration in a sample (in the proximity of surface layer) of Example A.
Figure 17:
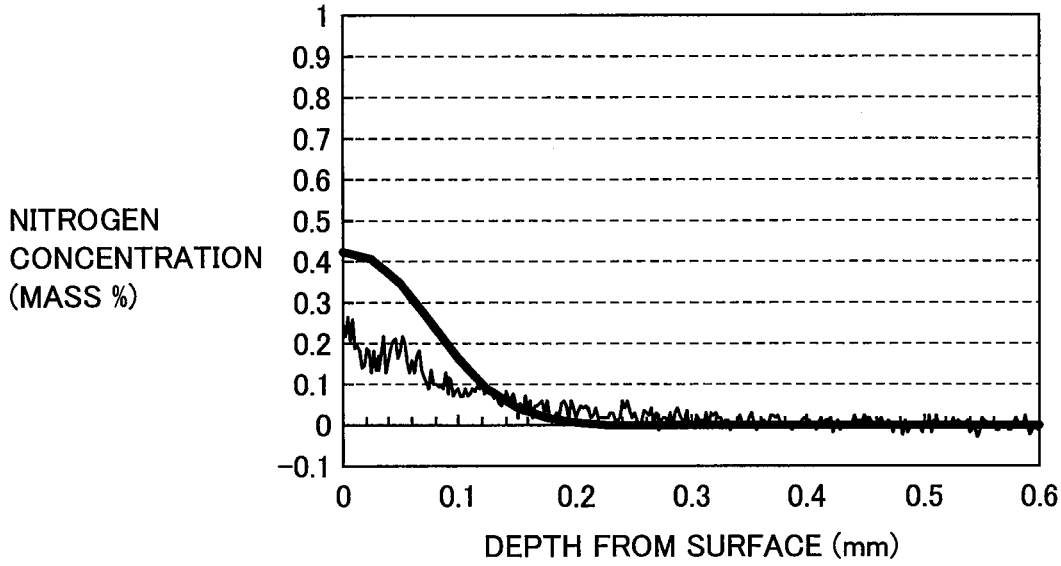
FIG. 17 represents a distribution of nitrogen concentration in a sample (in the proximity of surface layer) of Reference Example E.

The results of the experiment will be described hereinafter. FIG. 2 represents the measured results of the carbon activity and γ value of the aforementioned Examples A-C and Reference Examples A-E. In FIGS. 16 and 17, the horizontal axis represents the depth from the surface, whereas the vertical axis represents the nitrogen concentration. Further in FIGS. 16 and 17, the thin line represents the measured value of nitrogen concentration, whereas the bold line represents the expected value of nitrogen concentration calculated from the γ value and the like. In FIGS. 16 and 17, a closer match between the thin line and bold line represents a higher accuracy of control of the amount of nitrogen permeating into the sample.

TABLE 2

| | Distance d (mm) | Carbon activity | γ value |
|---|---|---|---|
| Example A | 50 | 0.95 | 4.75 |
| Example B | 100 | 0.96 | 4.57 |
| Example C | 150 | 0.95 | 4.75 |
| Reference Example A | 200 | 0.95 | 4.32 |
| Reference Example B | 300 | 0.96 | 4.68 |
| Reference Example C | 400 | 0.94 | 4.48 |
| Reference Example D | 500 | 0.97 | 4.41 |
| Reference Example E | 650 | 0.94 | 4.48 |

Referring to Table 2, it was confirmed that both the carbon activity and γ value were substantially equal to the target values (refer to Table 1) in all of Examples A-C and Reference Examples A-E. Referring to FIG. 16, with regards to the nitrogen concentration in proximity to the surface layer of a sample in Example A having opening 56A located in workpiece proximity region 93, the expected value of nitrogen concentration calculated from the γ value and the like and the actual measurement of nitrogen concentration measured by EPMA closely match each other. In other words, the nitrogen concentration in the sample is controlled with favorable accuracy in Example A. In contrast, with regards to the nitrogen concentration in proximity to the surface layer of the sample in Reference Example E having opening 56A located outside workpiece proximity region 93, the expected value of nitrogen concentration calculated from the γ value and the like differed significantly from the actual measurement of nitrogen concentration measured by EPMA, as shown in FIG. 17. In other words, the accuracy in controlling the nitrogen concentration in the sample is degraded in Reference Example E.

Figure 18:
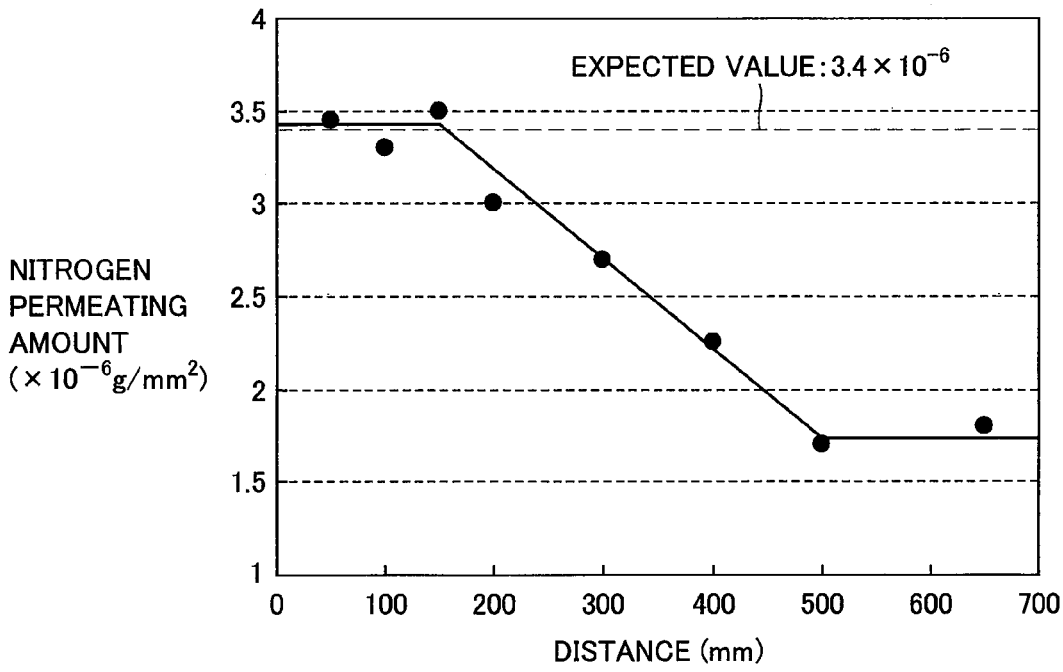
FIG. 18 represents the relationship between a nitrogen permeating amount and a distance d between the opening of an atmosphere collect pipe and a workpiece passage region.

As to the distribution of nitrogen concentration measured for Examples A-C and Reference Examples A-E, the nitrogen concentration from the surface towards the inner side of the sample was integrated to calculate the amount of nitrogen permeating into a sample from the unit area of the sample surface (nitrogen permeating amount). In FIG. 18, the horizontal axis represents the aforementioned distance d, whereas the vertical axis represents the nitrogen permeating amount. In FIG. 18, the expected value of the nitrogen permeating amount calculated from the γ value and the like is represented by a broken line. A nitrogen permeating amount closer to the expected value represents a higher accuracy of control of the amount of nitrogen permeating into a sample in FIG. 18.

Referring to FIG. 18, the calculated nitrogen permeating amount substantially matches the expected value when distance d is less than or equal to 150 mm that is within the range of opening 56A located in workpiece proximity region 93. When distance d was greater than or equal to 200 mm, the difference between the calculated nitrogen permeating amount and the expected value became greater in proportion to a longer distance d. A possible cause thereof is that the volume fraction of undecomposed ammonia in second heating zone 51C corresponding to a reaction chamber is not uniform, and the γ value or the like was controlled based on the measured result of the volume fraction of undecomposed ammonia at a region where the undecomposed ammonia volume fraction is higher than that in the proximity of the workpiece (sample) when distance d exceeds 150 mm. By the results set forth above, it was found that the nitrogen concentration in the workpiece can be controlled with favorable accuracy by setting the distance between the opening of the atmosphere collect pipe and the workpiece passage region to be less than or equal to 150 mm. In order to control the nitrogen concentration in the workpiece stably and with favorable accuracy, distance d between the opening of the atmosphere collect pipe and the workpiece passage region is preferably set to less than or equal to 100 mm.

EXAMPLE 2

Example 2 of the present invention will be described hereinafter. In a carbonitriding process, it is considered that the ammonia gas introduced into the heat treatment furnace flows in the furnace while the decomposition reaction advances to arrive at the surface of the workpiece, contributing to permeation of nitrogen into the workpiece. In order to confirm the validity of the experiment results in the above-described Example 1, an experiment was performed to study the distribution of volume fraction of undecomposed ammonia in heat treatment furnace 5 using CFD analysis. The procedure of the experiment is as set forth below.

At second heating zone 51C identified as a reaction chamber for a carbonitriding process, it is considered that the decomposition reaction of ammonia has not arrived at an equilibrium situation even if the internal atmosphere attains a steady state. In order to analyze the distribution of undecomposed ammonia volume fraction in second heating zone 51C, the reaction rate of the decomposition reaction of the introduced ammonia must be taken into account. To this end, an experiment was carried out to calculate the reaction rate constant of the ammonia decomposition reaction corresponding to the temperature and atmosphere at which a carbonitriding process is implemented.

Specifically, R gas, enriched gas, and ammonia gas were supplied into a batch type heat treatment furnace (volume 120 L), and the interior of the furnace was heated to 850° C. Upon confirming that the volume fraction of undecomposed ammonia in the furnace attained a steady state, supply of the aforementioned gas was stopped, and the time-dependent change in the undecomposed ammonia volume fraction was measured with an infrared analyzer. To confirm the reproducibility, similar measurements were made again. Table 3 represents the measurement results of the time-dependent change in the undecomposed ammonia volume fraction.

TABLE 3

| First time | | Second time | |
|---|---|---|---|
| Elapsed time(s) | Volume fraction (%) | Elapsed time(s) | Volume fraction (%) |
| 0 | 0.274 | 0 | 0.280 |
| 10 | 0.206 | 10 | 0.218 |
| 20 | 0.136 | 20 | 0.154 |
| 30 | 0.100 | 30 | 0.104 |
| 40 | 0.079 | 40 | 0.079 |
| 50 | 0.064 | 50 | 0.064 |
| 60 | 0.054 | 60 | 0.054 |
| 70 | 0.047 | 70 | 0.048 |
| 80 | 0.042 | 80 | 0.042 |
| 90 | 0.038 | 90 | 0.039 |
| 100 | 0.036 | 100 | 0.035 |
| 110 | 0.033 | 110 | 0.033 |
| 120 | 0.031 | 120 | 0.031 |
| 130 | 0.029 | 130 | 0.029 |
| 140 | 0.028 | 140 | 0.028 |
| 170 | 0.024 | 170 | 0.024 |
| 200 | 0.022 | 200 | 0.023 |
| 230 | 0.020 | 230 | 0.021 |
| 290 | 0.018 | 290 | 0.018 |
| 350 | 0.016 | 350 | 0.016 |
| 590 | 0.013 | 590 | 0.013 |

With reference to Table 3, it was confirmed that the time-dependent change in the undecomposed ammonia volume fraction carried out two times as set forth above has reproducibility. When the ammonia decomposition reaction corresponds to a quadratic rate equation, the ammonia decomposition rate at a certain time follows equation (1) set forth below. In this case, a linear relationship indicated in equation (2) is established between an inverse of the undecomposed ammonia volume fraction and the elapsed time.

$$-(dC_A/dt)=kC_A^2 \quad (1)$$

$$(1/C_A)-(1/C^O_A)=kt \quad (2)$$

where $C^O_A$ is the ammonia volume fraction at the start of measurement, $C_A$ is the ammonia volume fraction at an arbitrary time, t is the elapsed time from the start of measurement, and k is the reaction rate constant.

Figure 19:
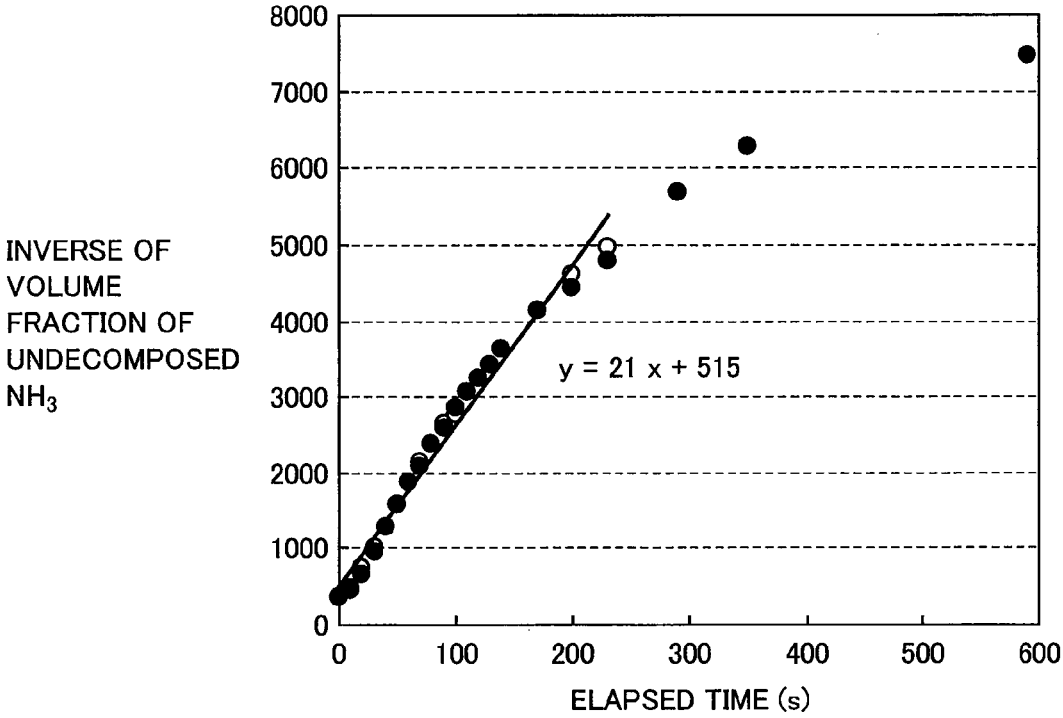
FIG. 19 represents the relationship between an inverse of the measured volume fraction of undecomposed ammonia and the elapsed time.

In FIG. 19, the horizontal axis represents the elapsed time from the start of measurement, whereas the vertical axis represents an inverse of the volume fraction of undecomposed ammonia. The open circle and the solid circle represent the measurement results of the first time and second time, respectively, in Table 3.

It is appreciated from FIG. 19 that a linear relationship is established between an inverse of the measured undecomposed ammonia volume fraction and the elapsed time in the range where the undecomposed ammonia volume fraction is greater than or equal to 0.04% (in the range where the value along the vertical axis in FIG. 19 is less than or equal to 2500). From this inclination of the straight line, the reaction rate constant was calculated as 21 ($s^{-1}$). It is appreciated therefrom that the ammonia decomposition rate is high, and the volume fraction of undecomposed ammonia that was 0.2%, for example, is reduced to 0.15% at an elapse of 8 seconds. Therefore, in consideration that the ammonia decomposition reaction has not reached an equilibrium situation in the heat treatment furnace, it was confirmed that the undecomposed ammonia volume fraction in the heat treatment furnace is readily rendered uneven.

Based on analysis conditions including the ammonia decomposition reaction rate defined by the rate constant of ammonia decomposition reaction set forth above, CFD analysis was made of the atmosphere in main unit 51 of heat treatment furnace 5 shown in FIG. 7. The conditions in the heat treatment are similar to those in Example 1. Although the CFD analysis can be implemented via various software, the analysis was conducted using STORM/CFD2000 (Adaptive Research Corporation) in the analysis. Since the volume fraction of undecomposed ammonia in the heat treatment furnace is sufficiently low, the effect of ammonia, even when decomposed, on the physical property of R gas is low. In the present example, the analysis was conducted with the ammonia decomposition as a passive scalar (advection diffusion with respect to a defined flow field, and concentration thereof will not affect the flow field).

The specification of the CFD analysis employed in the present example is shown in Table 4. The physical properties included in the analysis condition employed in the present example are shown in Table 5. The density and viscosity coefficient of the atmosphere were determined on the assumption of R gas having the composition of CO (carbon oxide): 20%, $N_2$ (nitrogen): 50%, and $H_2$ (hydrogen): 30% heated to 850° C. In the analysis, the initial concentration of ammonia introduced into the furnace was determined so as to match the measurement results of Example 1. A CFD analysis was conducted according to the aforementioned conditions, and calculation was terminated at the point of time of the flow rate distribution, pressure distribution, and undecomposed ammonia volume fraction in the furnace attaining a steady state.

TABLE 4

| | |
|---|---|
| Space discretization method | Finite volume method |
| Time discretization method | Pure implicit method |
| Analytical model | Isothermal, uncompressed, turbulence |
| Turbulence model | $k \cdot \epsilon$ model |
| Schmidt number | 0.9 |
| Equation to be solved | Equation of continuity, equation for conservation of momentum, equation for conservation of $NH_3$ content, equation for conservation of k, $\epsilon$ |
| Wall boundary condition | No slip |

TABLE 5

| | |
|---|---|
| Density of atmosphere ($kg/m^3$) | 0.22 |
| Viscosity coefficient of atmosphere ($\mu Pa \cdot s$) | 43.8 |
| Reaction rate constant of ammonia (1/s) | 21 |

Figure 20:
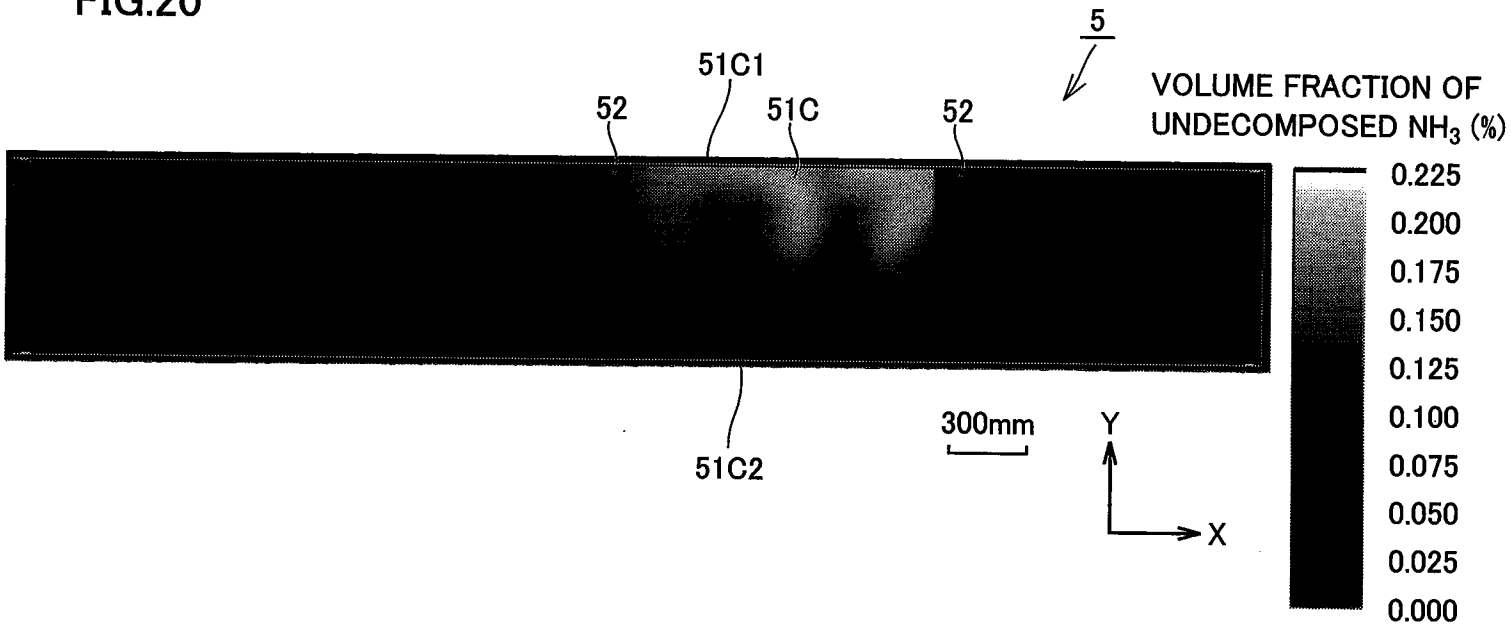
FIG. 20 represents a result of CFD analysis at a cross section taken along line XX-XX of FIG. 7.
Figure 21:
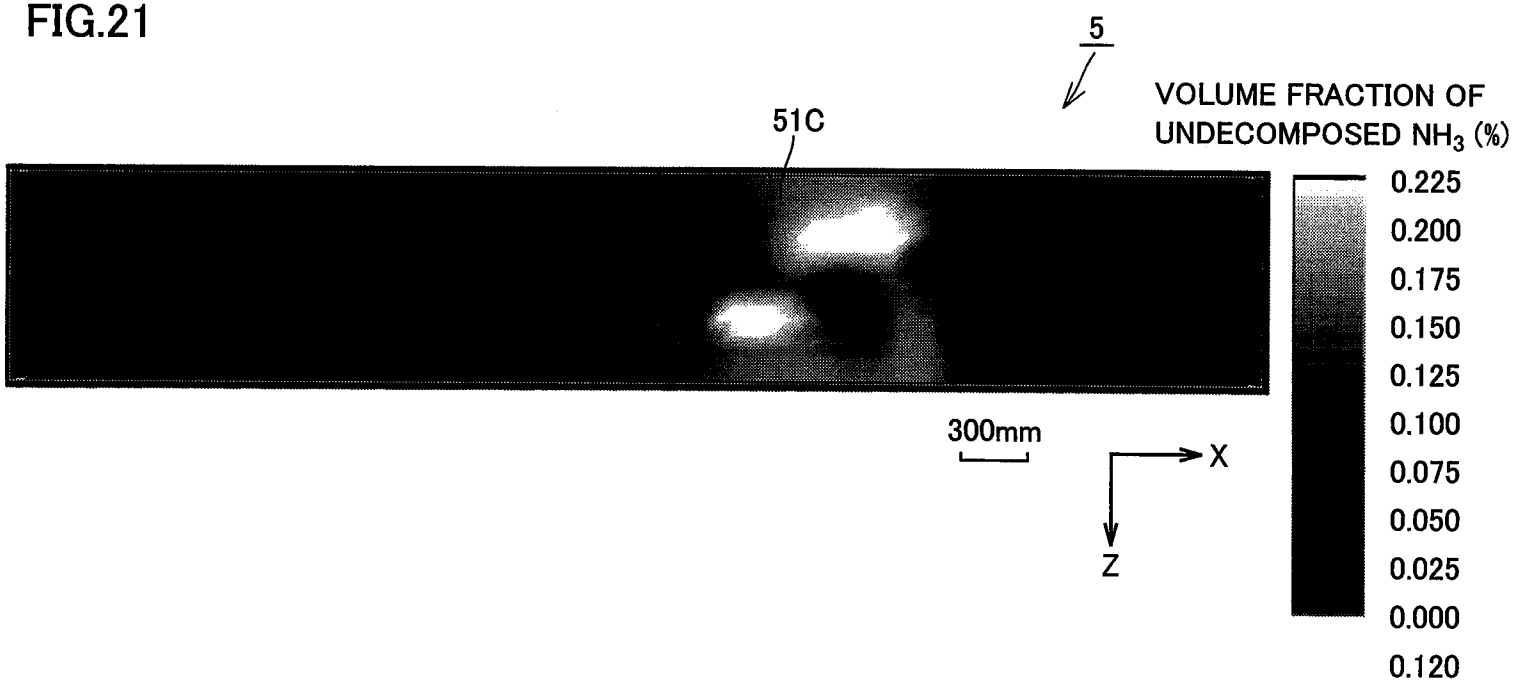
FIG. 21 represents a result of CFD analysis at a cross section taken along line XXI-XXI of FIG. 7.
Figure 22:
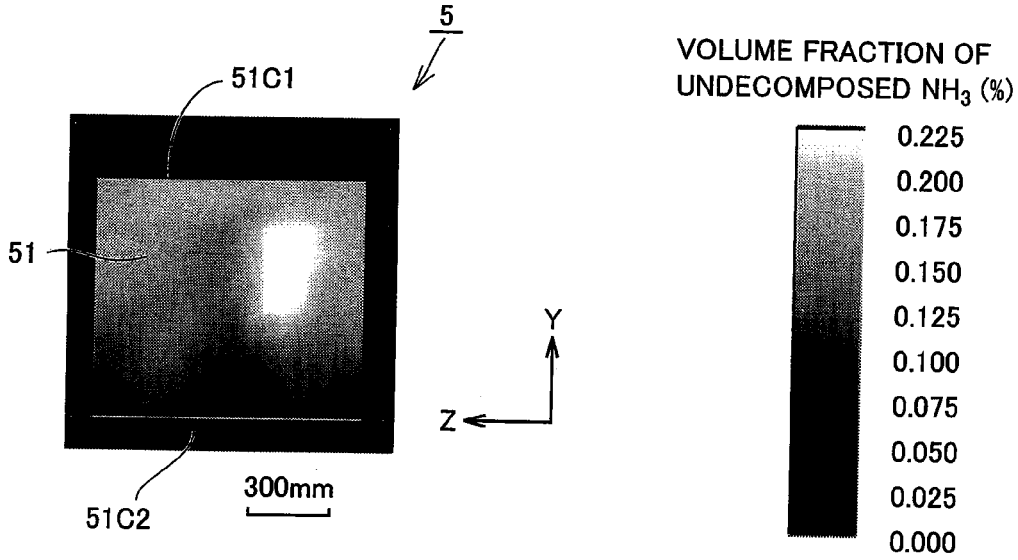
FIG. 22 represents a result of CFD analysis at a cross section taken along line XXII-XXII of FIG. 7.

In FIGS. 20-22, the white region represents the region where the undecomposed ammonia volume fraction is highest, and the volume fraction becomes lower where the region attains a blacker tone. It was confirmed, as shown in FIGS. 20-22, that the undecomposed ammonia volume fraction in second heating zone 51C varied significantly. Referring to FIGS. 7, 8 and 20, the undecomposed ammonia volume fraction in the proximity of top wall 51C1 at second heating zone 51C where atmosphere gas supplier 61 and atmosphere collect pipe 56 are installed is high, whereas the undecomposed ammonia volume fraction in the proximity of bottom wall 51C2 at second heating zone 51C close to workpiece passage region 92 is low. This is because the ammonia gas introduced from the region close to top wall 51C1 at second heating zone 51C, where atmosphere gas supplier 61 and atmosphere collect pipe 56 are installed, has a high decomposition rate until arrival at the neighborhood of bottom wall 51C2 at second heating zone 51C close to workpiece passage region 92.

The reason why the difference between the actual nitrogen permeating amount to workpiece 91 and the expected value became larger as a function of longer distance d from opening 56A of atmosphere collect pipe 56 to workpiece passage region 92 in the experiment results of Example 1 is considered to be caused by the atmosphere being controlled based on the collection of the atmosphere at a region where the undecomposed ammonia volume fraction is higher than that of workpiece passage region 92 as the distance d between opening 56A and workpiece passage region 92 becomes longer. Therefore, in order to control the nitrogen concentration in the workpiece with favorable accuracy in the carbonitriding process based on the fact that the results of the experiment in Example 1 are appropriate, it is preferable to collect atmosphere at a region where the difference in the undecomposed ammonia volume fraction is within 25% from that of the region occupied by the workpiece in the heat treatment furnace, more specifically a region where the distance from the region occupied by the workpiece is less than or equal to 150 mm, in the case where CFD analysis is conducted based on analysis conditions including the ammonia decomposition reaction rate, and adjust the atmosphere in the heat treatment furnace based on the volume fraction of undecomposed ammonia in that atmosphere.

Figure 23:
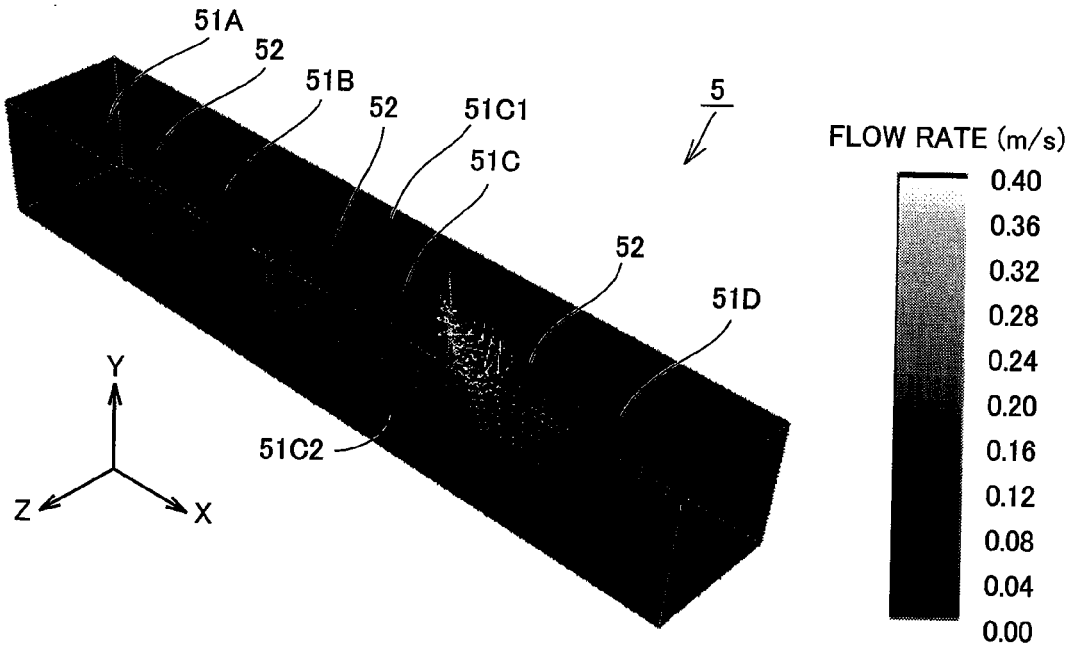
FIG. 23 represents a flow rate distribution of atmosphere in a heat treatment furnace according to Examples 1 and 2, obtained by the CFD analysis of Example 2.

According to the conditions of the experiment in Example 1 and Example 2 set forth above, the flow rate of the atmosphere in the heat treatment furnace is reduced. Referring to FIGS. 7, 8 and 23, at second heating zone 51C of heat treatment furnace 5, the flow rate is highest around top wall 51C1 where atmosphere gas supplier 61 and fan 59 are arranged, i.e. approximately 0.3 m/s, and approximately 0.1 m/s at other regions. This is a low value, as compared to general heat treatment conditions. The undecomposed ammonia volume fraction becomes more uniform as the flow rate of the atmosphere in the heat treatment furnace becomes higher. Namely, the experiments of Examples 1 and 2 are carried out under conditions where the undecomposed ammonia volume fraction in the heat treatment furnace is readily rendered uneven.

Further, the carbonitriding temperature of 850° C. is employed in Examples 1 and 2. In the case where high-carbon steel is employed as the material, the carbonitriding temperature is generally set in the vicinity of 850° C., specifically greater than or equal to 830° C. and less than or equal to 870° C.

Therefore, in the case where a workpiece formed of high-carbon steel is subjected to a carbonitriding process at the carbonitriding temperature of 830° C. to 870° C., arranging the atmosphere collect member in the heat treatment furnace such that the atmosphere in the region where the distance from the region occupied by the workpiece is less than or equal to 150 mm is particularly effective. As used herein, high-carbon steel refers to steel containing carbon of at least 0.8 mass %, i.e. eutectoid steel and hypereutectoid steel. For example, JIS SUJ2 that is a bearing steel, SAE52100 and DIN standard 100Cr6 equivalent thereto, as well as JIS SUJ3, and JIS SUP3, SUP4 that are spring steels, HS SK2, SK3 that are tool steels, and the like can be enumerated.

Thus, by collecting and analyzing the atmosphere in the proximity of the workpiece in the heat treatment (carbonitriding process) of steel, and controlling the atmosphere in the heat treatment furnace based on the analyzed result, the atmosphere in the heat treatment furnace can be controlled with favorable accuracy. According to the heat treatment furnace of the present invention allowing the distance between the opening of the atmosphere collect member and the holder holding the workpiece to be modified, the position of the opening of the atmosphere collect member, even when the configuration and/or mass of the workpiece is changed, can be altered. Thus, the atmosphere in the heat treatment furnace can be controlled with favorable accuracy.

The embodiments and examples have been described based on, but not limited to, implementing a carbonitriding process as the heat treatment in the heat treatment furnace of the present invention. The heat treatment furnace of the present invention also can be applied effectively for heat treatment where the atmosphere in the proximity of a workpiece is preferably collected, such as in carburizing.

It should be understood that the embodiments and examples disclosed herein are illustrative and non-restrictive in every respect. The scope of the present invention is defined by the terms of the claims, rather than the description above, and is intended to include any modification within the scope and meaning equivalent to the terms of the claims.

Industrial applicability

The heat treatment furnace of the present invention is particularly applied advantageously as a heat treatment furnace in which the atmosphere therein should be controlled with favorable accuracy.

The invention claimed is:

1. A heat treatment furnace for carrying out heat treatment of steel, comprising:

a reaction chamber including a holder to hold a workpiece, and an atmosphere collect member having an opening in said reaction chamber to collect an atmosphere in said reaction chamber through said opening, said atmosphere collect member configured to extend or retract to allow a distance between said opening and said holder to be altered when the configuration and/or mass of said workpiece is changed; wherein the atmosphere collect member is further configured to locate said opening in a region having components identical to that of the atmosphere in contact with the workpiece.

2. The heat treatment furnace according to claim 1, further comprising:

a seal member surrounding an outer circumferential face of said atmosphere collect member, and an outward wall portion surrounding an outer circumferential face of said seal member, and connected to an outer wall of said reaction chamber, wherein said atmosphere collect member is installed in a manner relatively movable with respect to said outward wall portion.

3. The heat treatment furnace according to claim 2, wherein said atmosphere collect member includes a cylindrical portion having a tubular configuration, said seal member is arranged to surround an outer circumferential face of said cylindrical portion, and said atmosphere collect member is installed in a manner relatively movable with respect to said outward wall portion in an axial direction of said cylindrical portion.

4. The heat treatment furnace according to claim 2, further comprising a cooling portion to cool said seal member.

5. The heat treatment furnace according to claim 1, wherein said heat treatment includes a carbonitriding process, said heat treatment furnace further comprising:

an atmosphere analyzer connected to said atmosphere collect member to calculate a volume fraction of undecomposed ammonia in said atmosphere collected by said atmosphere collect member, and an atmosphere controller connected to said atmosphere analyzer to control said atmosphere in said reaction chamber based on said calculated volume fraction of undecomposed ammonia.

* * * * *